United States Patent [19]

Teates et al.

[11] 4,355,496

[45] Oct. 26, 1982

[54] WRAPPING MACHINE AND METHOD

[75] Inventors: N. Grove Teates, Wheaton; Riley H. Mayhall, Jr., Burtonsville, both of Md.

[73] Assignee: Systemation Inc., Wheaton, Md.

[21] Appl. No.: 893,324

[22] Filed: Mar. 31, 1978

[51] Int. Cl.[3] ..... B65B 11/04; B65B 13/04

[52] U.S. Cl. ..... 53/587; 53/211; 100/15

[58] Field of Search ..... 53/211, 526, 528, 587, 53/399, 436, 465, 214; 100/3, 15; 156/446; 92/2; 91/533; 242/56 A

[56] References Cited

U.S. PATENT DOCUMENTS

| | | | |
|---|---|---|---|
| 1,123,606 | 1/1915 | Smith | 53/588 |
| 2,568,260 | 9/1951 | Spagnoli | 53/587 X |
| 2,644,307 | 7/1953 | Blair | 91/533 |
| 3,097,462 | 7/1963 | Langdon | 53/586 X |
| 3,221,641 | 12/1965 | Adams et al. | 53/587 |
| 3,262,246 | 7/1966 | Olsen et al. | 53/587 |
| 3,333,394 | 8/1967 | Reisinger et al. | 53/528 |
| 3,577,702 | 5/1971 | Bescridt | 100/15 |
| 3,605,375 | 9/1971 | Marshall | 53/528 |
| 3,613,169 | 10/1971 | Ziegler | 92/2 |
| 3,673,950 | 7/1972 | Koehler et al. | 100/3 X |
| 3,799,469 | 3/1974 | Oga et al. | 242/567 |
| 3,955,340 | 5/1976 | Tomita | 53/587 |
| 3,994,118 | 11/1976 | Felix | 100/15 X |

*Primary Examiner*—John Sipos

*Attorney, Agent, or Firm*—Nathaniel A. Humphries

[57] ABSTRACT

A package wrapping machine has a frame supporting a power driven rotary horizontal shaft with a turret plate member on the end of the shaft supporting two spaced tine banks; a stack of package components is clamped between the tine banks by pneumatic cylinders on the turret plate moving one tine bank toward the other. The end of a plastic film web W extending from a roll on the frame is clamped to the package components when they are rotated a predetermined number of rotations to effect the wrapping of the package components; a hot film cut-off means severs the web of plastic film from the wrapped package following the wrapping of the package and a pusher plate between the tine banks is extended by a cylinder to kick the completed package from between the tine banks, control means actuates the clamping means, rotary member, said film cut-off means and pusher plate in timed sequence.

14 Claims, 23 Drawing Figures

166
164
165
162
46
160
154
152
150
5
5
102
36
32
90
33
34
146
148
132
17
136
18
16
58
38
140
142

13
13
58
88
90
56
70
86
84
82
74
64
76
78
126
80
60
114
120
116
122
118
94
62
92
72
124
-162-
-162-
-162-
-162-
-162-
113
111
112
110
58
86
70
72
82

WRAPPING MACHINE AND METHOD

This invention is in the field of packaging and is more specifically directed to a new and improved method and apparatus for wrapping a package with plastic film material so as to provide a strong and protective enclosure of the package in an economical manner. The term "package" as used herein is employed in its broadest generic sense and can comprise a plurality of bags, bundles or the like which are desired to be associated together in a unitary grouping or a single such bag or similar item about which it is desired to provide a protective wrapping or covering. For example, the finished package provided by the inventive apparatus and method can consist of a plurality of bags such as bags of dog food, potting soil or the like. Other examples of items capable of being associated together by the inventive apparatus and method into a unitary package includes tubes, cartons, cans and rolls which are wrapped together by the inventive apparatus and method to provide a utilized package consisting of a desired plurality of the particular items being wrapped.

The most common form of conventional packaging is the well-known cardboard box or carton which comes in a variety of sizes and configurations in accordance with the nature of the items for which the box or carton is intended to receive. Unfortunately, cardboard boxes and cartons suffer from a number of disadvantages such as the fact that they do not permit the product to be easily viewed to present an attractive package to prospective purchasers. Another disadvantage of cardboard boxes and cartons is that they do not provide a weatherproof protective enclosure and consequently cannot be stored outdoors or in other areas where they may be exposed to the effects of moisture. Another significant problem with the use of cardboard boxes or cartons is that they are expensive in that substantial energy costs are involved in their manufacture and transportation due to the fact that they are heavy and relatively bulky. Moreover, cardboard boxes present a substantial disposal problem after they have been emptied. Yet another disadvantage of cardboard boxes is that they require substantial storage space when empty and labor for assembly.

Recognition of the foregoing problems has resulted in a number of both fully automatic and manual rotational wrapping machines which are used for wrapping items with thermoplastic film in a variety of ways. Unfortunately, the known wrapping machines suffer from a lack of versatility in that they are capable of usage for wrapping only products within a relatively narrow range of dimensional configurations. In other words, many of the machines will only wrap a particular type and size of item such as a boxed or pallet mounted item and are incapable of usage for wrapping other items having a different nature, configuration and/or dimensions. Another disadvantage of the prior known wrapping machines resides in the fact that they effect the wrapping operation by rotating the items being wrapped about a vertical axis or push them through a web tunnel which results in poor web tension. One of the problems of many machines arrives from the fact that items being wrapped are always maintained in an unchanging fixed vertical orientation; consequently, if the items consist of bags or the like containing powdered or similar materials which tend to settle, the bags will bulge outwardly at their bottom portions so as to result in a non-symmetric finished package which is both aesthetically unattractive and functionally deficient in not being capable of being easily stacked or stored. Another shortcoming of many conventional machines is that they present safety hazards to the operator in that clothing or the like of the operator can be engaged by the moving parts to inflict serious injury or death on the operator.

The present invention, on the other hand, solves the foregoing problems in its preferred embodiment by the employment of a thermoplastic film wrapping apparatus having clamping means consisting of two vertically spaced parallel banks of horizontal tines which receive the items to form the package between the two tine banks. The upper tine bank then moves toward the items to be wrapped which are supported on the lower tine bank to clamp and hold the items between the tine banks for rotation about a horizontal axis during the wrapping of the package with wrapping material from a supply roll. The package components are rotated to continuously invert them during the wrapping operation and are not permitted to settle and/or distort the finished package.

The package resultant from the present invention is aesthetically attractive, permits visual inspection of its contents when desired and is of generally square or rectangular configuration so as to be easily stacked or stored with similar packages. Moreover, the resultant package provides a substantial energy cost savings over cardboard box and carton packaging following usage. A safety feature of the invention is a pivotally mounted guard shield adjacent the area in which the package components are wrapped; the guard shield has an opening through which the package components are moved for positioning on the lower tine bank. Prior to the commencement of rotation of the package components to begin a wrapping operation, the guard shield swings outwardly to insure that the operator is clear of the machine and cannot possibly be injured by its operation.

Therefore, the primary object of this invention is the provision of a new and improved apparatus and method of wrapping items to form a package.

Achievement of the foregoing object is enabled by the preferred embodiment by the provision of a machine frame supporting a horizontal main drive shaft mounted for rotation about its axis and having a vertical turret plate mounted at one end with a fixedly attached first bank of horizontal clamp and support tines fixedly attached to and extending from the turret plate and a second bank of movable horizontal clamp tines on the turret plates mounted for movement toward or away from the bank of fixedly attached tines on the turret plate. The area between the two tine banks comprises a loading and wrapping station for the package components to be wrapped in that a stack of bags or other package componments is positioned on the fixedly attached tines, which are always in a lower position below the movable bank of tines when the turret is stopped at the end of a cycle in a loading position. Clamp cylinder means on the turret are provided with a pressurized work fluid such as compressed air for moving the uppermost movable bank of tine members downwardly to clamp the package components together against the lower bank of tines to hold the package components for subsequent rotation of the turret and the clamped components about the horizontal axis of rotation of the main drive shaft. Such clamping also effects the clamping of the end of a web of thermoplastic wrap material extending from a supply roll of such material on the machine frame against the uppermost package component. Consequently, rotation of the package components serves to wrap the web of thermoplastic material about the package components with the number of wraps depending upon the number of rotations of the main drive shaft. Rotation of the turret is stopped automatically after a predetermined number of rotations and a transversely movable carriage mounted for reciprocation perpendicularly to the axis of rotation of the main drive shaft toward and away from the loading station is moved forward toward the wrapped package in the station. A hot cutter knife mounted on the carriage consequently engages the taut web of wrapping material extending from the package up to the supply roll to sever the web immediately and a presser plate on the carriage moves against the web end below the hot cutter knife just prior to engagement of the web by the knife and serves to smooth out and press the web end against the underlying thermoplastic wrapping to bond it thereto and provide a finished package; a non-heated web cutter knife can be optionally employed if desired.

The carriage is then moved back from the package and pressure by the tines on the finished package component P is released to permit a pusher plate mounted on the turret adjacent one end of the package to be actuated to discharge the completed package by stripping it outwardly along and from the tines.

The guard shield is then automatically returned to its inner closed position and the apparatus is then ready for a subsequent loading of package components. An air curtain provided by a plurality of air jets in a manifold on the carriage blows the severed end of the web extending from the supply roll upwardly above the loading area in which the next stack of components are to be positioned so that downward movement of the upper tine bank clamps the web end to the stacked package components and subsequent rotation of the package components and tines unreels the web from the roll by the wrapping of the web about the package components.

In an alternative embodiment, a fluid power cylinder on the carriage has an elasometric pusher member on its rod which is extended prior to loading to engage the web end for providing a mechanical positioning of the web end above the package components beneath the upper tine banks in addition to the positioning effected by the air curtain.

A better understanding of the preferred embodiments of the invention will be achieved when the following written description is considered in conjunction with the appended drawings, in which.

Figure 1:
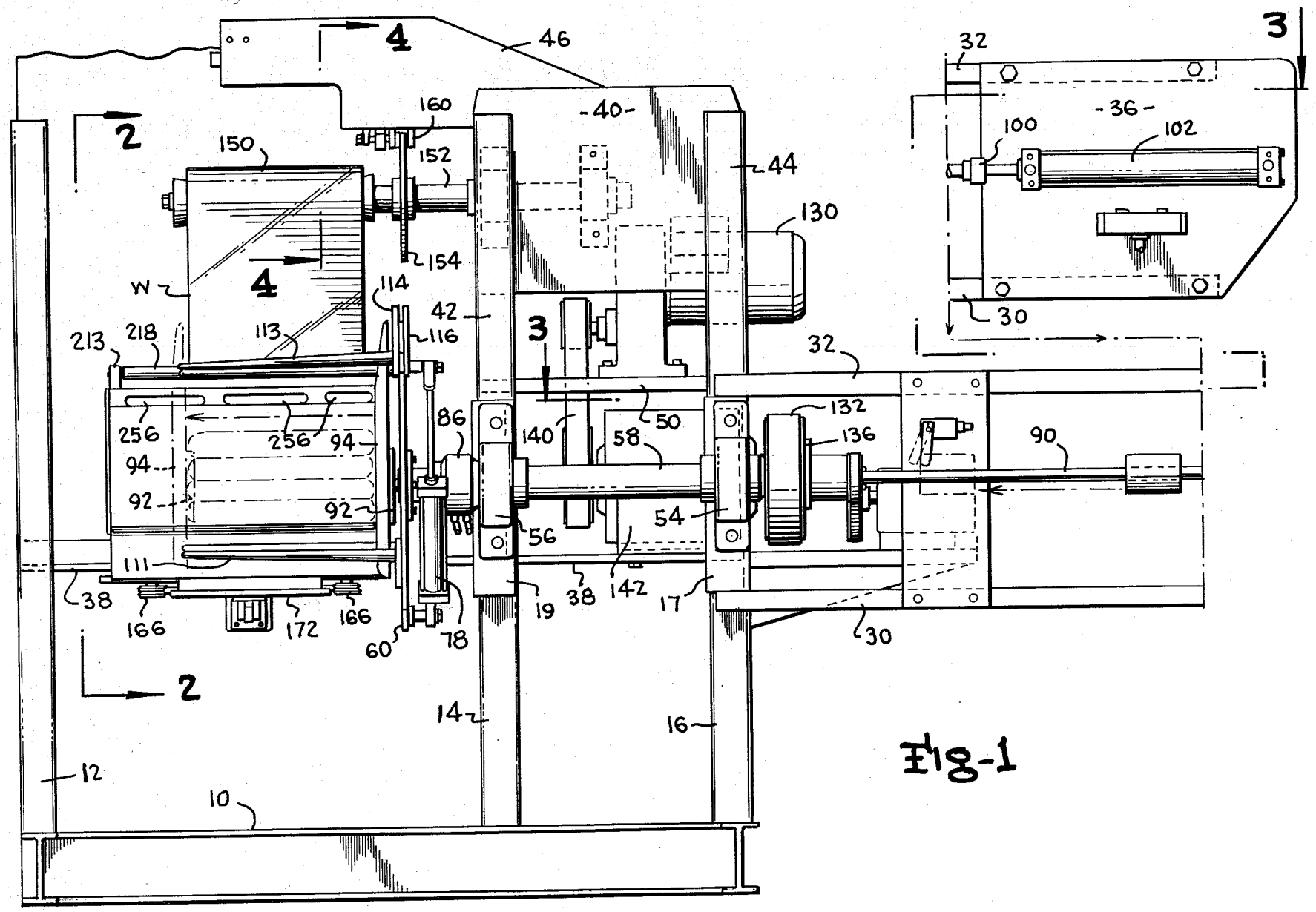
FIG. 1 is a front elevation view of a first embodiment of the invention with the housing removed for clarity.
Figures 3, 4, 5:
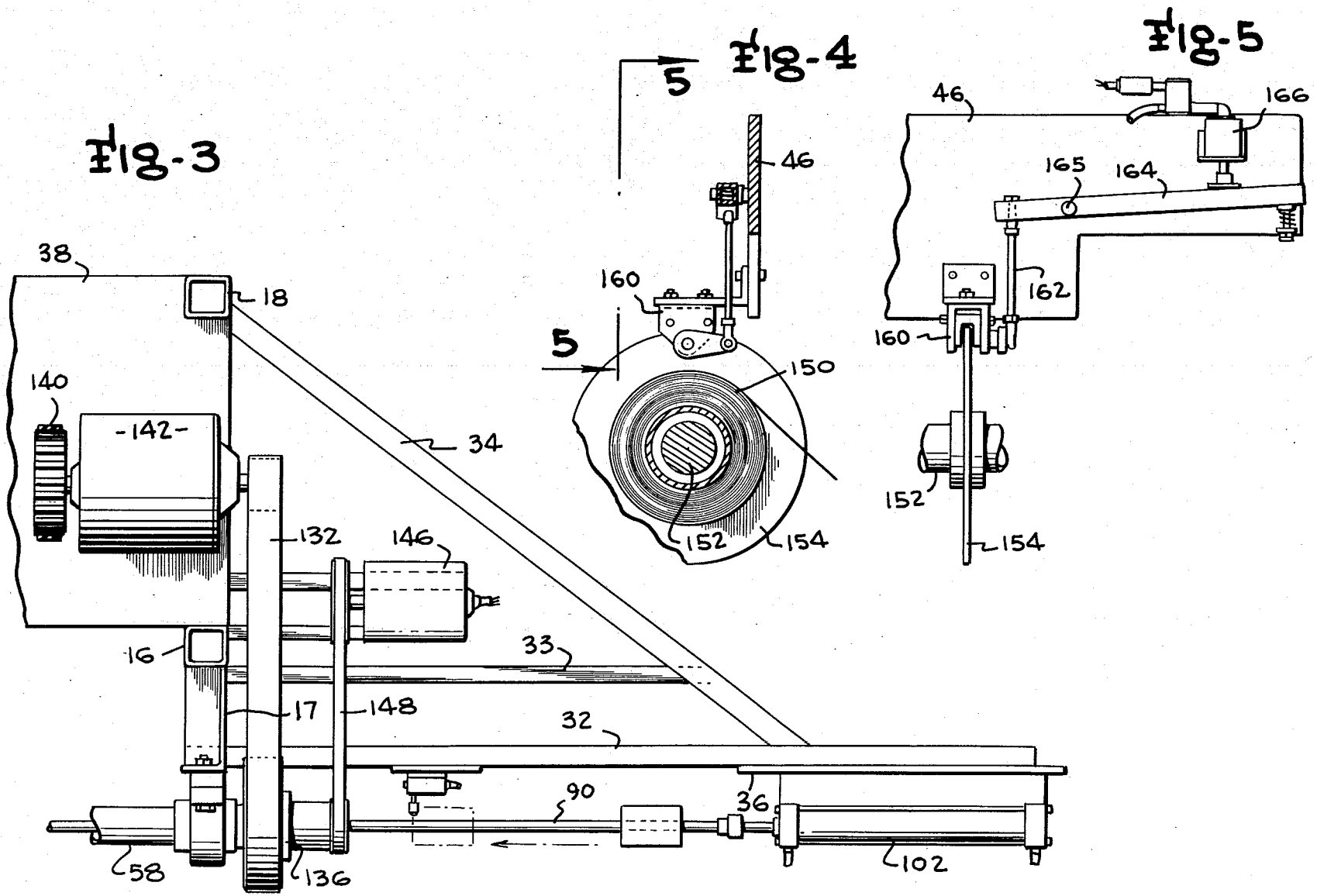
FIG. 3 is a sectional view taken along lines 3—3 of FIG. 1.
FIG. 4 is a sectional view taken along lines 4—4 of FIG. 1.
FIG. 5 is a sectional view taken along lines 5—5 of FIG. 4.

Attention is initially invited to FIG. 1 of the drawings which comprises a front elevation of a first embodiment of the invention which includes a main frame on which the remaining components are mounted. The main frame includes a base frame component 10 and main vertically extending front frame components 12, 14 and 16 illustrated in FIG. 1. Additionally, the main frame also includes rear vertical frame members 18, 20 and 22 illustrated in FIGS. 2, 3 and 6. A forwardly extending angle bracket 17 is mounted in a cantilevered manner on the front side of vertically extending frame component 16 and a similar forwardly extending cantilevered angle bracket 19 is mounted in the same manner of the front face of vertically extending frame member 14. A composite cantilever frame consisting of horizontal members 30, 32 and 33 extends outwardly to the right of vertical frame members 16 and is braced by a diagonal brace member 34 connected to vertical frame member 18 as best illustrated in FIGS. 1 and 3. A vertical plate 36 is connected to the outer ends of the horizontal members 30 and 32 as best shown in FIG. 1.

Figure 2:
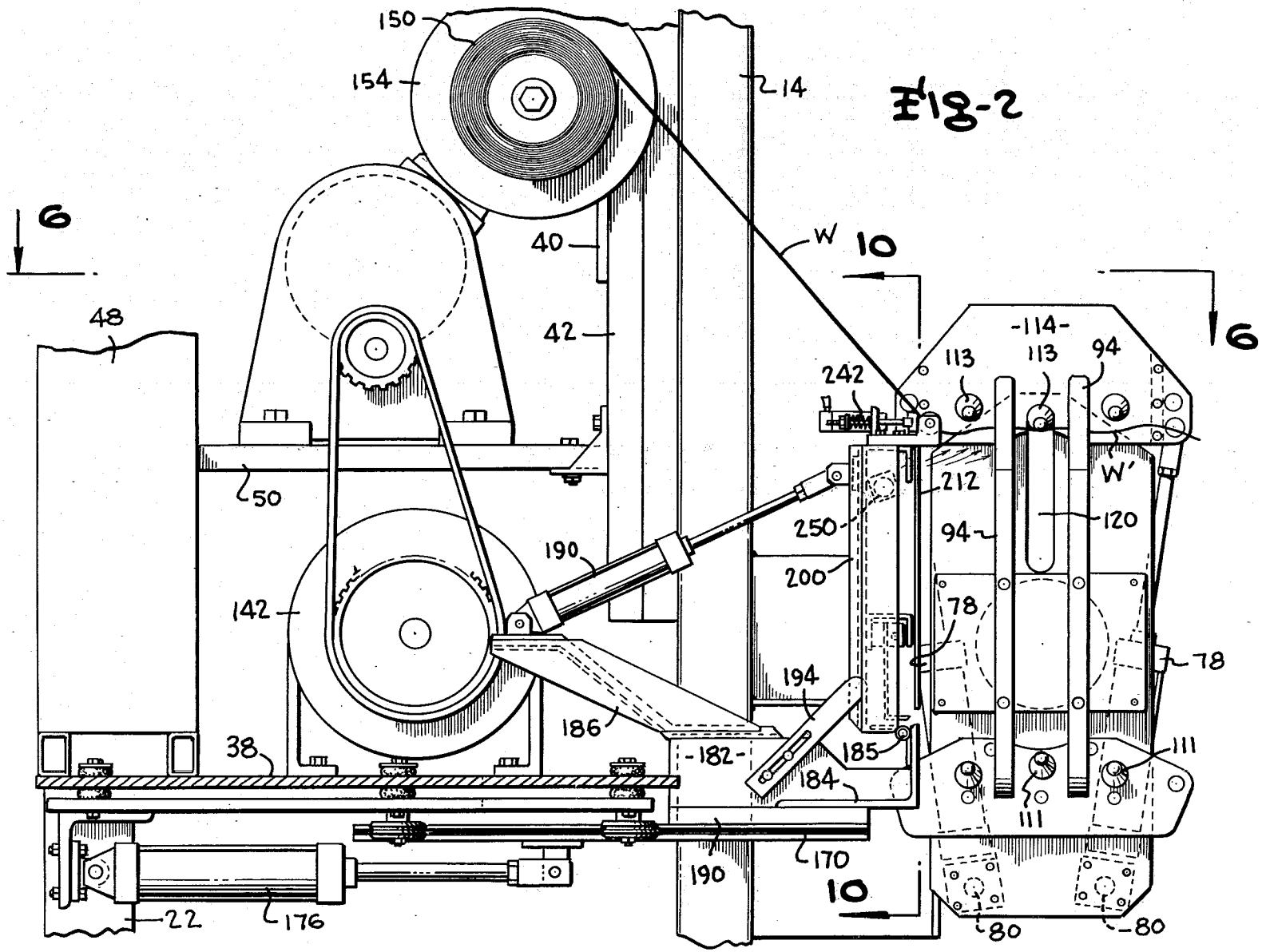
FIG. 2 is a sectional view taken along lines 2—2 of FIG. 1.
Figure 6:
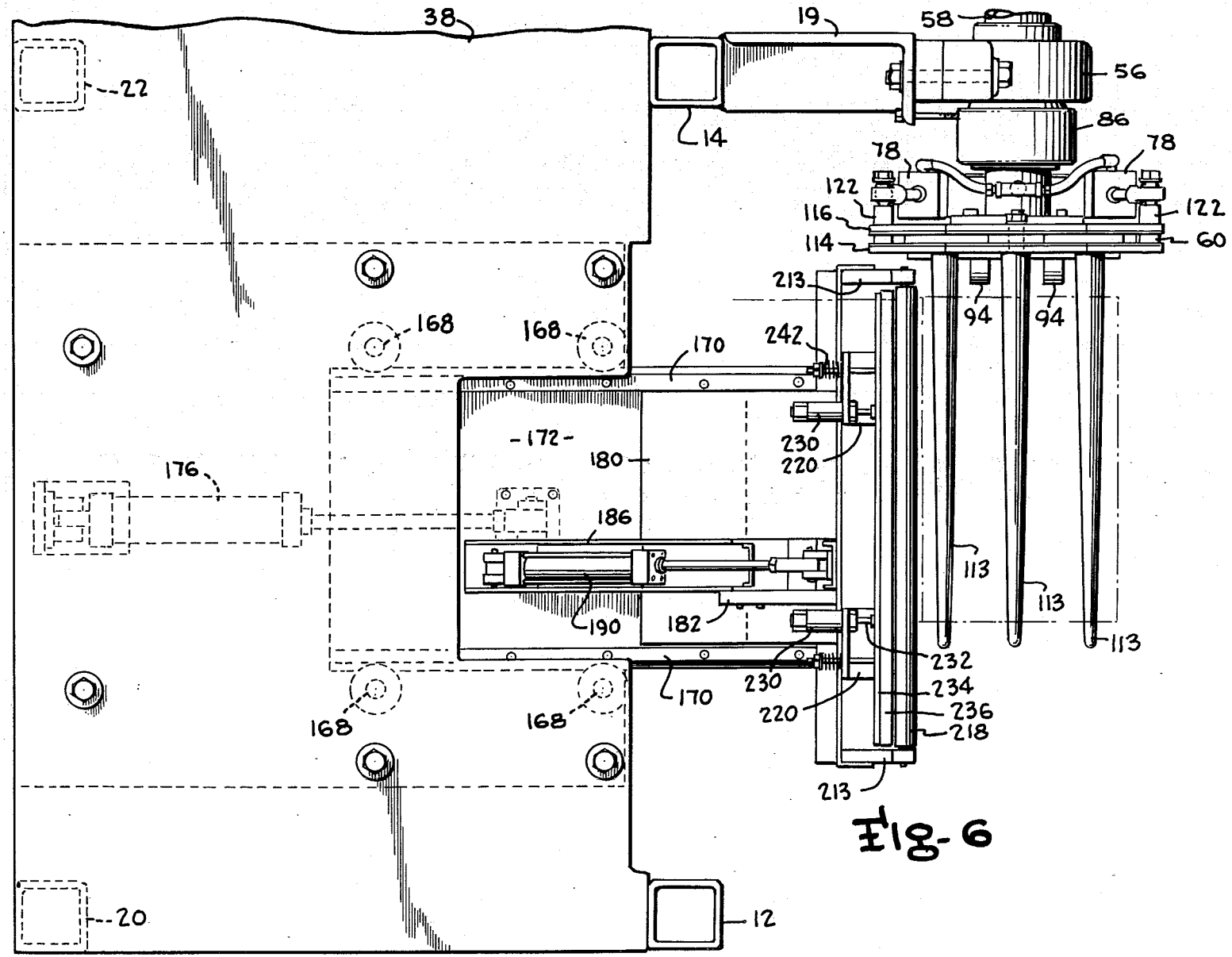
FIG. 6 is a sectional view taken along lines 6—6 of FIG. 2.

A main horizontal frame plate 38 extends along the rear portion of the apparatus at an intermediate elevation and is supported by the vertical frame components with it being noted that the vertical frame components 18, 20 and 22 do not extend above the upper surface of the main horizontal frame plate 38 as illustrated in FIG. 6. A vertical mounting plate 40 is attached to vertical elements 42 and 44 respectively mounted on the rear sides of vertical frame components 14 and 16 with a cantilever brake support arm 46 extending outwardly to the left and rear of member 40 as shown in FIG. 1. A control housing 48 is provided along the rear of the frame means and includes internal frame means (not shown) with a horizontal motor support plate 50 extending forwardly of the housing 48 and having its forward end connected to vertical elements 42 and 44 as shown in FIG. 2.

Forward angle brackets 17 and 19 respectively support main shaft bearings 54 and 56 in which a main shaft 58 is journaled for rotation. A vertically oriented turret plate 60 is mounted on the forward end of the main shaft 58 in abutting relationship with a radial flange 62 (FIG. 12) to which the main turret plate 60 is connected by bolt and nut assemblies 64.

Figures 12, 13:
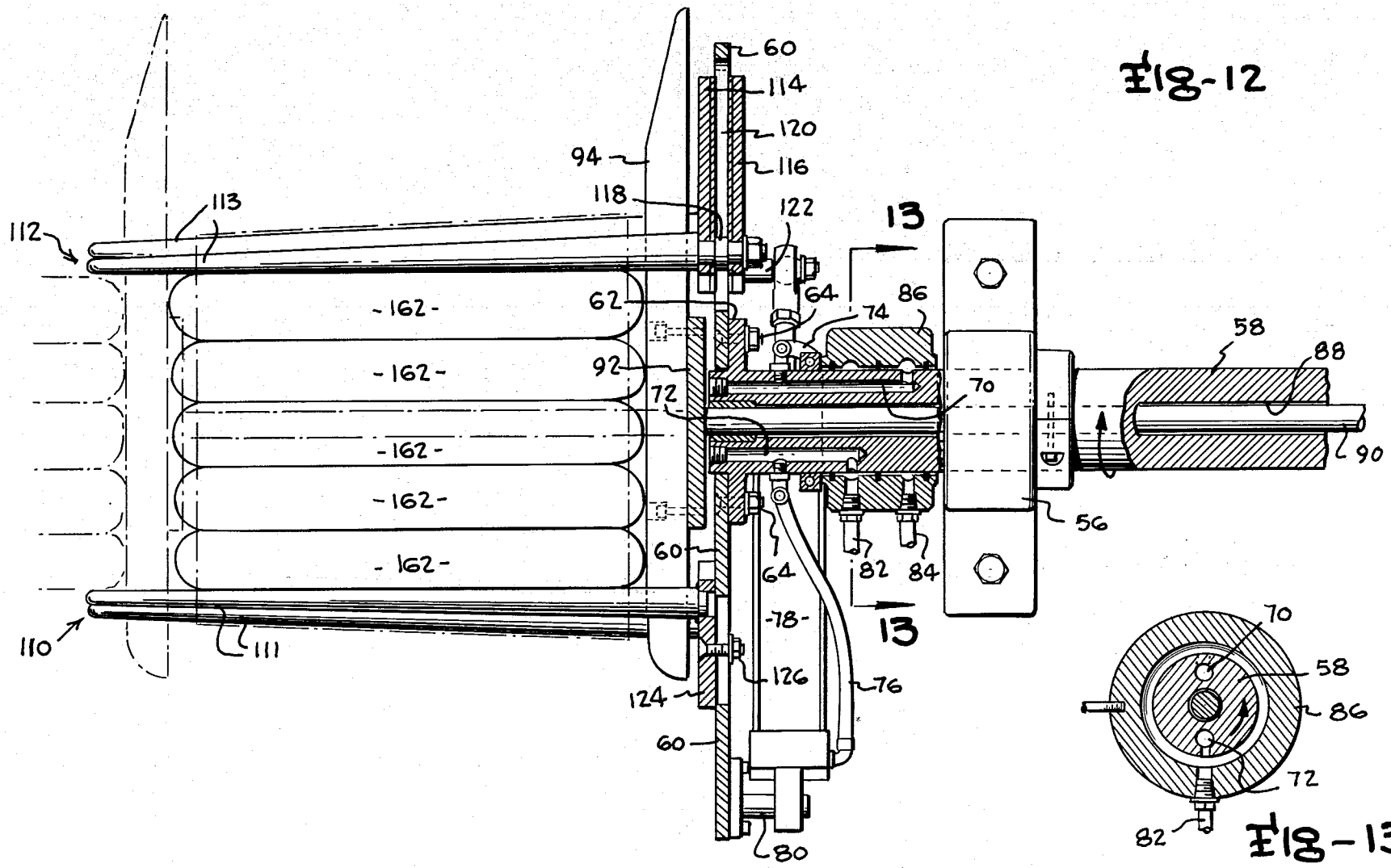
FIG. 12 is a sectional view taken along lines 12—12 of FIG. 7.
FIG. 13 is a sectional view taken along lines 13—13 of FIG. 12.

The front end portion of the main shaft 58 also includes first and second fluid power passageways 70 and 72 with a fluid power hose 74 being in communication with passageway 70 by means of a fitting as shown in FIG. 12 and a similar hose 76 being in communication with the passageway 72 in like manner. Hose members 74 and 76 are each respectively connected to opposite ends of a pair of product clamping fluid power cylinders 78 which have their cylinder portions mounted on pivot members 80 extending from the rear face of turret plate 60. Passageways 70 and 72 also respectively communicate with hose members 82 and 84 connected to a rotary coupling 86 as shown in FIG. 12. The hose members 82 and 84 extend from a control valve connected to the output of an air tank or other source of compressed air illustrated in FIG. 19 to permit the supplying of pressurized air to either of hose members 82 and 84 while the other hose member is connected to atmosphere. Consequently, it will be appreciated that air pressure can be applied to either hose member 76 or hose member 74 for effecting simultaneous extension or retraction of the cylinders 78 which operate package clamping means to be discussed hereinafter. It should be understood that while compressed air is used to operate the air cylinders and the like of the preferred embodiment, any other pressurized power fluid such as hydraulic fluid could be used if desired.

An axial bore 88 extends the entire length of the main shaft member 58 with a push rod 90 being mounted in the axial bore and having a pusher plate 92 attached to its forward end. A pair of pusher bars 94 is connected to the front face of the pusher plate 92. The rearmost end of push rod 90 is connected by a coupling 100 to the end of the rod of a pusher cylinder 102 mounted on frame plate 36 which is selectively operable for extension and retraction by conventional air pressure supply and control means. It will be seen that extension of pusher cylinder 102 will cause the pusher plate 92 and the attached pusher bars 94 to move to the left from the solid line position of FIG. 12 to the dotted line position of the same figure.

Additionally, the main turret plate 60 also provides support for two banks of clamp tines consisting of a lower fixedly positioned bank of tines 111 and an upper movably mounted bank 112 of clamp tines 113. Each of the clamp tines is of elongated tapered configuration with the axis of the tines extending in a horizontal manner as best illustrated in FIG. 12. The tines 113 of the upper bank of tines are fixedly connected at their larger ends to first and second tine support plates 114 and 116 respectively positioned on opposite sides of the main turret plate 60. Tine support plates 114 and 116 are held in their spaced relationship by spacer means including at least one spacer slider bearing 118 positioned in a slot 120 formed in the turret plate 60. Pivot shaft members 122 are respectively connected to the ends of plate 114 and 116 and to the outer end of the rods of each of the fluid power cylinder members 78. Consequently, simultaneous actuation of the cylinder members 78 effects movement of the upper movable bank 112 of tines 113 toward and away from the lower bank of tines 111 in an obvious manner. The tines 111 of the lower bank of tines 110 are mounted by their larger end portions on a fixed tine support plate 124 which is fixedly connected to the lower portion of the main turret plate 60 as viewed in FIG. 12 so that actuation of cylinders 78 results in movement of tines 113 toward or away from tines 111.

It will be appreciated that the lower tine support plate 124 is attached to the main turret plate 60 by means of nut and bolt members 126 provided in desired openings in the main turret plate 60 so as to permit vertical adjustment of the spacing of tines 111 from tines 113 as viewed in FIG. 12.

Figure 6A:
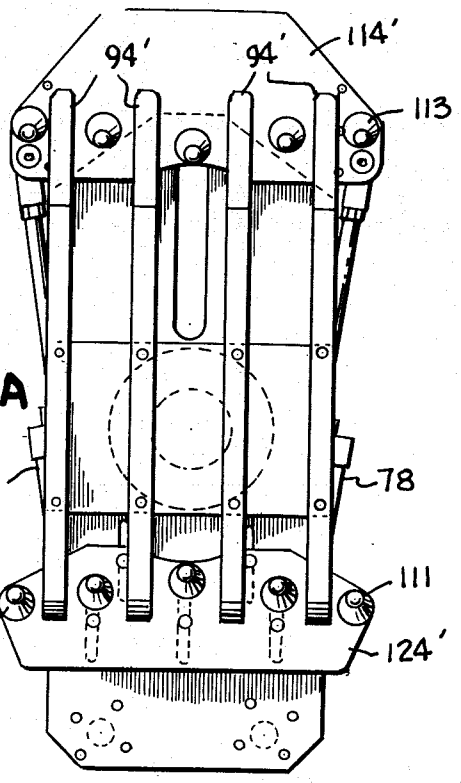
FIG. 6A is a side elevation of a portion of an alternative embodiment of a portion of the apparatus.

FIG. 6A illustrates an alternative turret embodiment in which a fixed tine support plate 124' and a movable tine support plate 114' respectively support five tines which are associated with four pusher bars 94'. This embodiment is essentially identical to the first embodiment in all other respects and serves to exemplify the versatility that can be achieved by the use of different numbers and geometric arrangements of tines and pusher bars in accordance with the nature and size of the items being wrapped.

Rotational drive for the main shaft 58 is provided by a main drive motor 130 which is a gear motor and is drivingly connected by a toothed drive belt 140 to the input of an electric clutch-brake unit 142 in which either the clutch or brake is always activated; a unitary motor-clutch-brake unit could be used if desired. The main drive motor 130 is a variable speed motor and can be of the type providing continuous speed variation or can alternatively be of the stepped incremented speed change type in which plural windings are sequentially activated or deactivated to give desired output speed variation. Clutch-brake unit 142 has an output to a toothed belt 132 extending to an input sheave 136 keyed to shaft 58. Additionally, a conventional control means 146 including revolution counter is drivingly connected to the main drive shaft 58 by a belt 148 with the control means 146 also having cyclically operated internal switches for actuating different elements of the machine at proper times during each cycle. For example, switches in means 146 serve to terminate actuation of the clutch and to actuate brake means in unit 142 after shaft 58 has rotated a predetermined number of revolutions during a wrapping cycle of operation.

A roll 150 of plastic wrap material is supported on a shaft 152 to which a brake disc 154 is keyed. Air or mechanical brake means 160 is associated with the disc 154 so that upon full actuation of the brake means 160 the disc 154 is clamped to immediately retard rotation of shaft 152 and associated roll 150. It will be observed that the brake means 160 is connected by a linkage 162 to pivot link 164 on pivot 165 to a pneumatic or air cylinder 166 which is automatically actuated by conventional control means. It should be understood that the brake means 160 can be of the type directly actuated by air if desired and that the brake always applies a predetermined amount of drag to shaft 152 to provide film tension or braking of roll 150.

Figure 14:
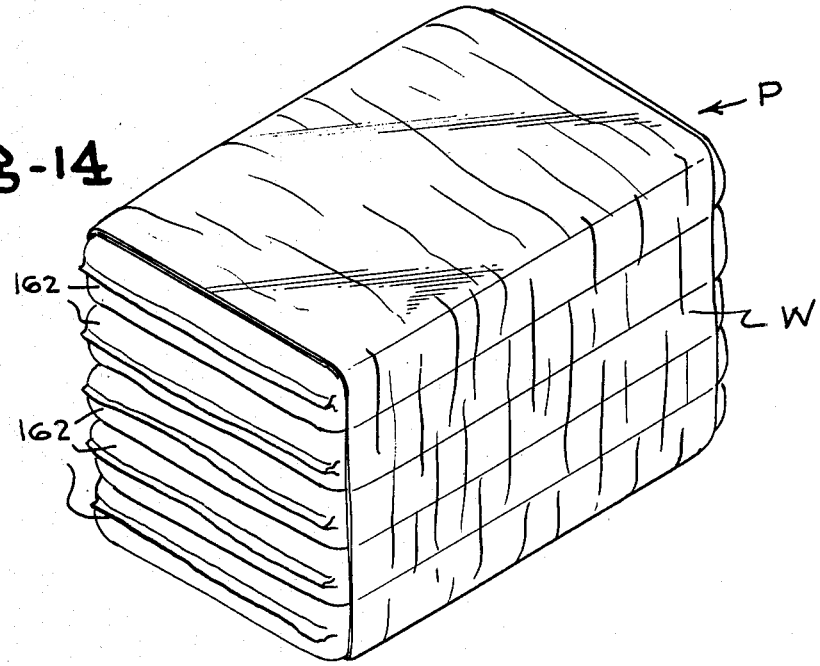
FIG. 14 is a perspective view of the wrapped package provided by operation of the preferred embodiments of the invention.

A web of transparent or opaque plastic wrap material is unreeled from the roll 150 for the purpose of being wrapped about a plurality of package components such as bags 162 to provide a resultant package P illustrated in FIG. 14.

Means for guiding, cutting and pressing the wrapping material against the package during each cycle of operation are provided on a reciprocating carriage mounted for movement in a horizontal plane beneath the main frame plate 38 by means of a plurality of grooved rollers 166 which are supported on vertical shafts 168 beneath plate 38. Rollers 166 engage and roll along side tracks 170 extending along opposite edges of a carriage plate 172 as shown in FIG. 10. Carriage plate 172 and the components attached to the carriage plate are capable of being reciprocated between a forward extended position illustrated in FIGS. 2 and 9 and a retracted position illustrated in FIG. 8 with movement of the carriage plate being effected by a carriage plate drive cylinder 176 having its cylinder end fixedly mounted on the framework and having its rod connected by a fitting 177 to the bottom of carriage plate 172.

Figure 11:
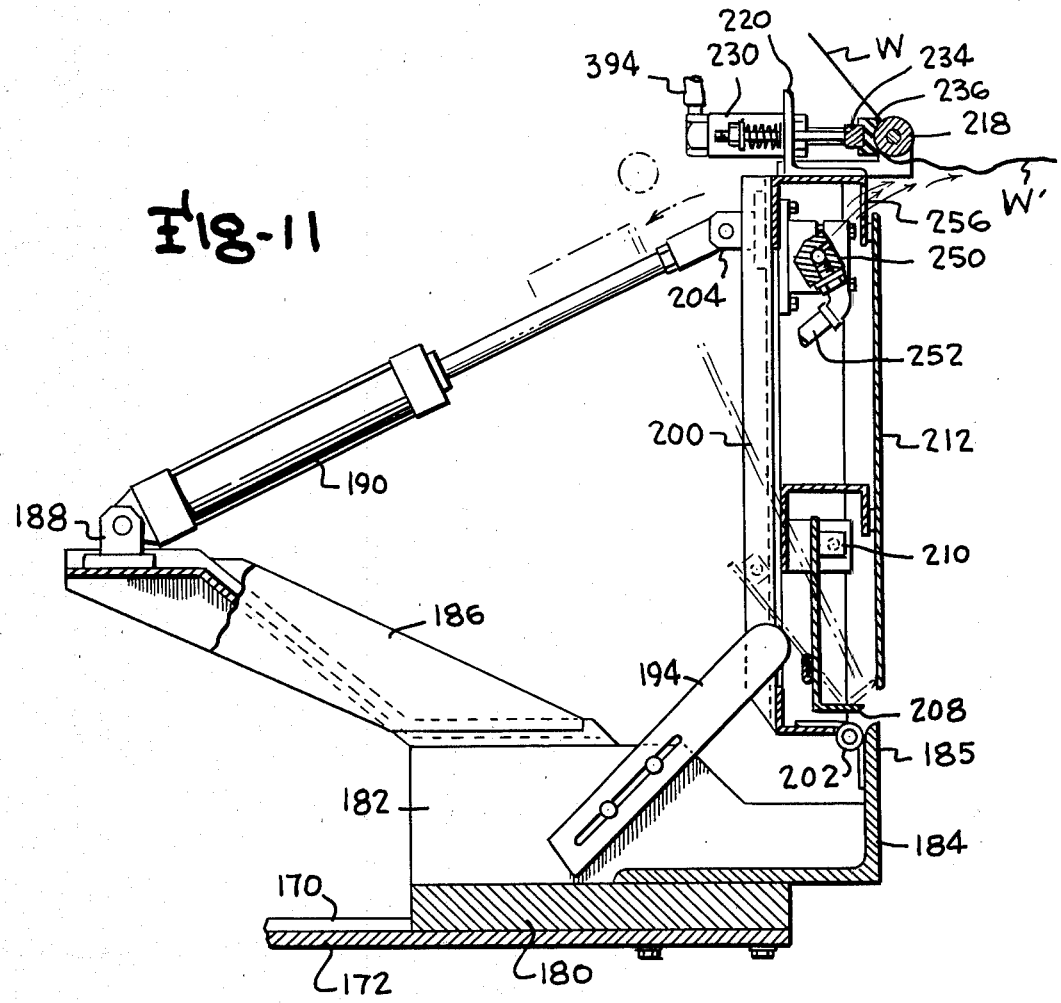
FIG. 11 is a sectional view taken along lines 11—11 of FIG. 10.

A spacer plate 180 is attached to the upper surface of carriage plate 172 and provides support for a mounting block 182 with an angle member 184 being mounted between elements 180 and 182 and extending forwardly thereof as best shown in FIG. 11. Angle member 184 has a vertical presser plate component 185 which is engagable with the side of a package held by tines 111, 113 for a purpose to be discussed. An inclined frame 186 extends outwardly from the mounting block 182 and has a cylinder mounting bracket 188 on which a cylinder 190 is pivotally mounted as illustrated in FIG. 2. Additionally, a fixed cuter actuator cam 194 is attached to block 182 and extends upwardly into the interior of a swing gate housing 200 which is mounted for pivotal movement about pivot 202 fixed to the rear face of presser plate 185 as shown in FIG. 11. Swing gate housing 200 is connected by a bracket and fitting 204 to the end of the rod of tilt cylinder 190 so that actuation of the tilt cylinder serves to swing the swing gate housing about pivot 202 in an obvious manner.

Figure 8:
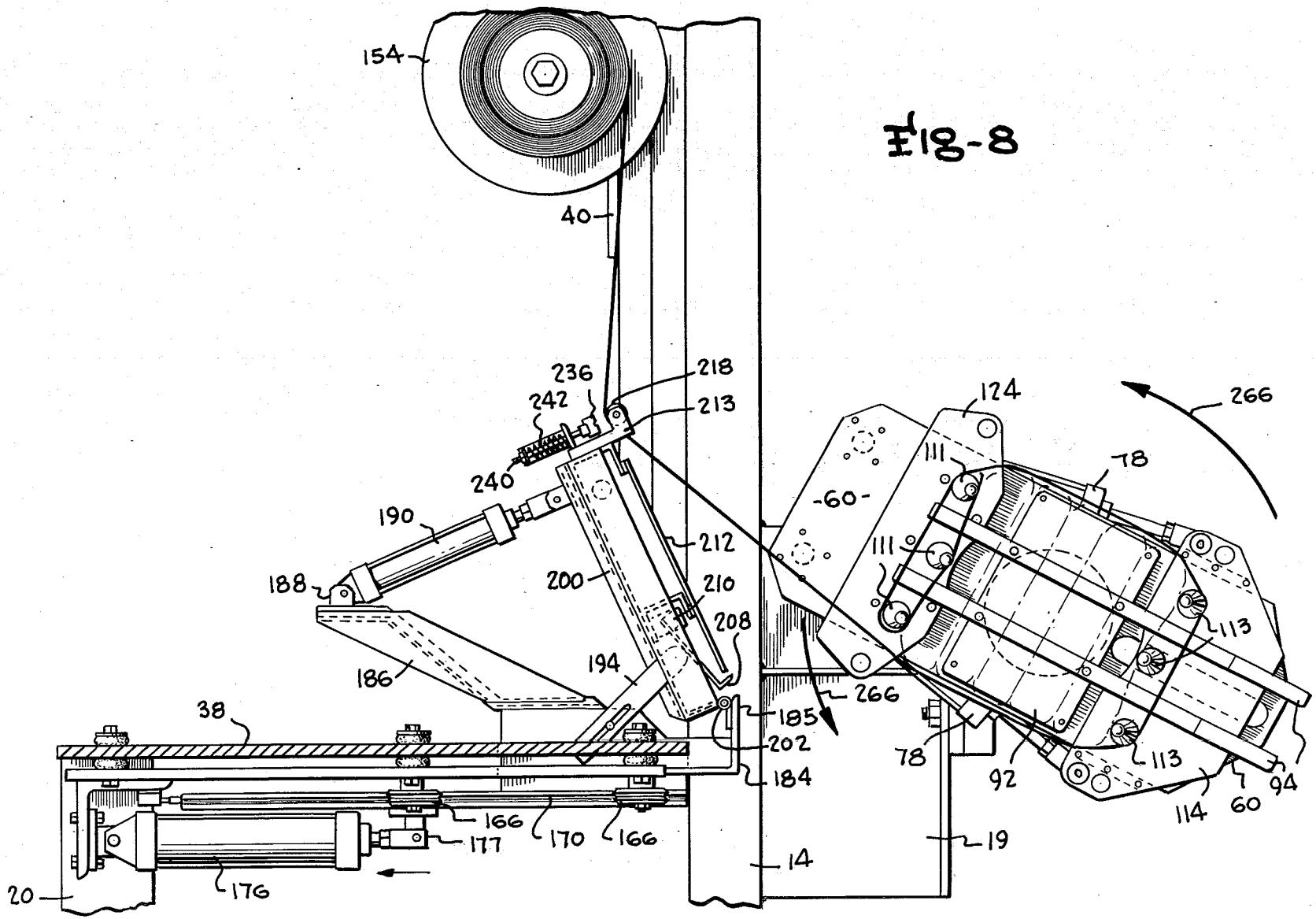
FIG. 8 is a sectional view similar to FIG. 7, but illustrating the parts in a subsequent position during a cycle of operation.

Swing gate housing 200 provides support for a number of web control means including a heated cut-off knife 208 which is heated by conventional electrical heating means (not shown) and which is supported for pivotal movement about a pivot 210 on the interior of the swing gate housing 200. A back or load positioning plate 212 extends along the forward face of the swing gate housing 200 with the cutoff knife being positioned below the lower edge of the plate 212. Retraction of tilt cylinder 190 causes the fixed cutter actuator cam 194 to engage the cutoff knife and pivot it about pin 210 to extend its cutting edge beyond plate 212 as illustrated in FIG. 8 while extension of cylinder 190 results in positioning of the cutting edge inwardly of the housing behind backplate 212 as shown in FIG. 11.

Two roll support brackets 213 (FIGS. 8 and 13) are mounted on the upper edge of opposite sides of the swing gate housing and provide support for an idler film guide roller 218 which extends across the width of the upper edge of the swing gate housing and is of a length greater than the width of the film web W. Additionally, two angle brackets 220 are mounted on the upper edge of the swing gate 200 with each angle bracket supporting an air clamp cylinder 230 having a pushrod 232 positioned behind and contacting a film clamp bar assembly 234. The web W passes between the film clamp bar assembly 234 which includes a rubber strip 236 fixed to bar 234 and the backup roller 218. Consequently, actuation of the cylinder members 230 moves the clamp bar assembly to clamp the web between the rubber strip 236 and roller 218 to hold the web in a fixed position. Cylinders 230 are one-way cylinders and the film clamp bar assembly is returned to its retracted position illustrated for example in FIG. 7 by means of a pair of return rods 240 which are biased by springs 242 to the left as viewed in FIG. 7.

A hollow manifold member 250 is provided on the interior of the swing gate housing 200 in a manner best illustrated in FIGS. 10 and 11 and is connected to a pressurized air supply hose 252 extending to a control valve which provides compressed air at the end of a cycle of operation following the severing of the web member so that a plurality of air jets issue from aligned openings 254 extending along the length of the manifold member 250. The air issuing from the openings 254 passes through slots 256 (FIG. 10) in the housing above the upper edge of back plate 212 to engage the end of the web immediately after the severing operation to blow the web end W' outwardly in a horizontal manner as shown in FIG. 11.

Figure 15:
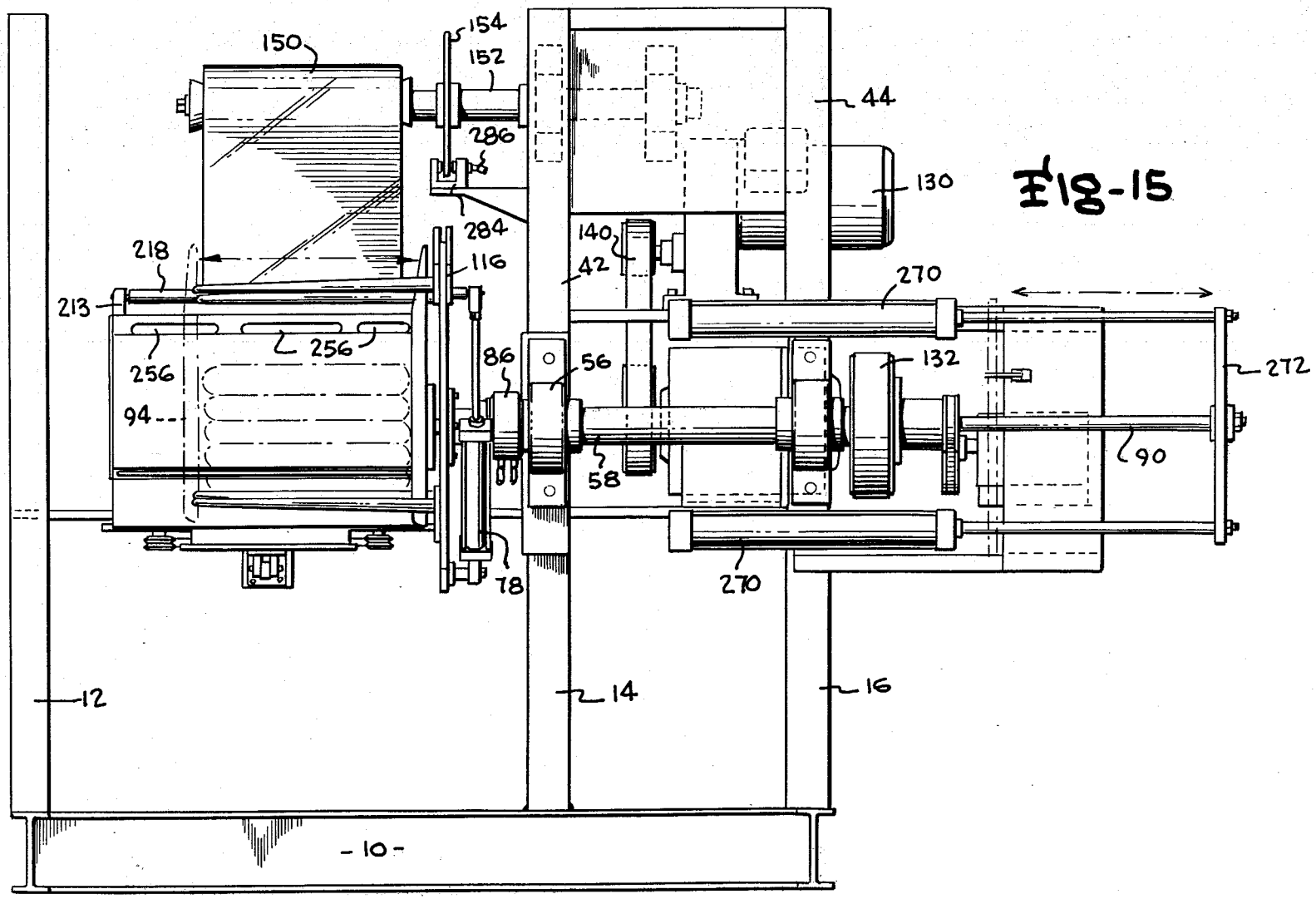
FIG. 15 is a front elevation of a second embodiment of the invention with the housing removed for clarity.
Figure 16:
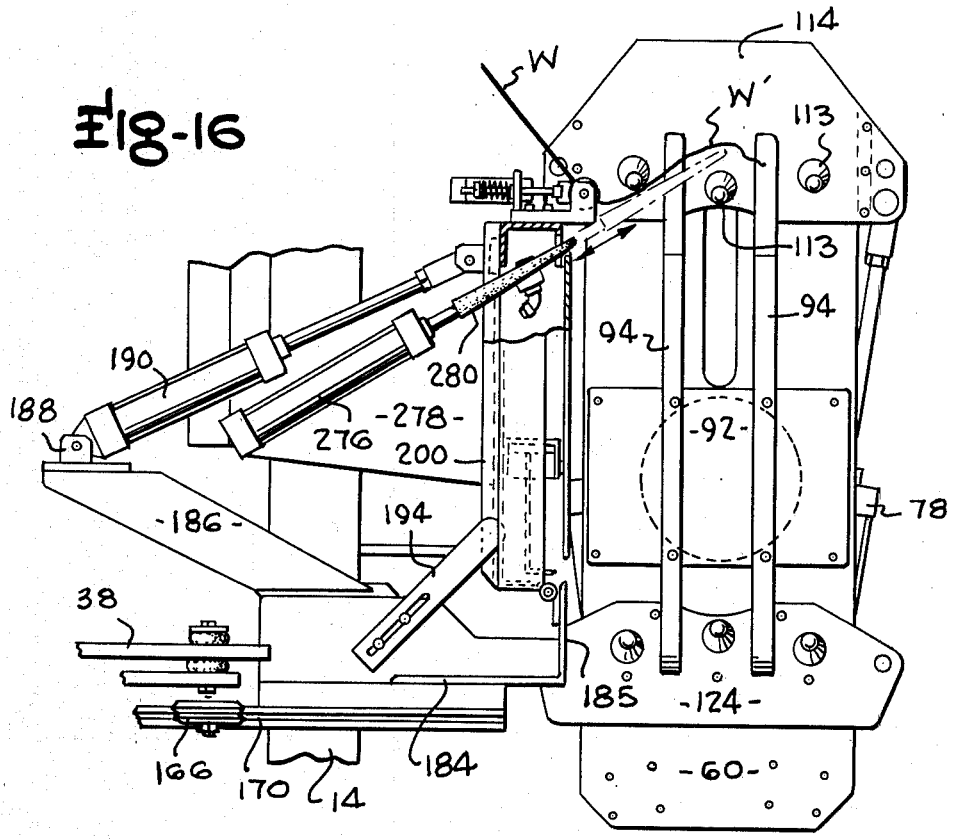
FIG. 16 is a left side elevation of a portion of the embodiment of FIG. 15.
Figure 17:
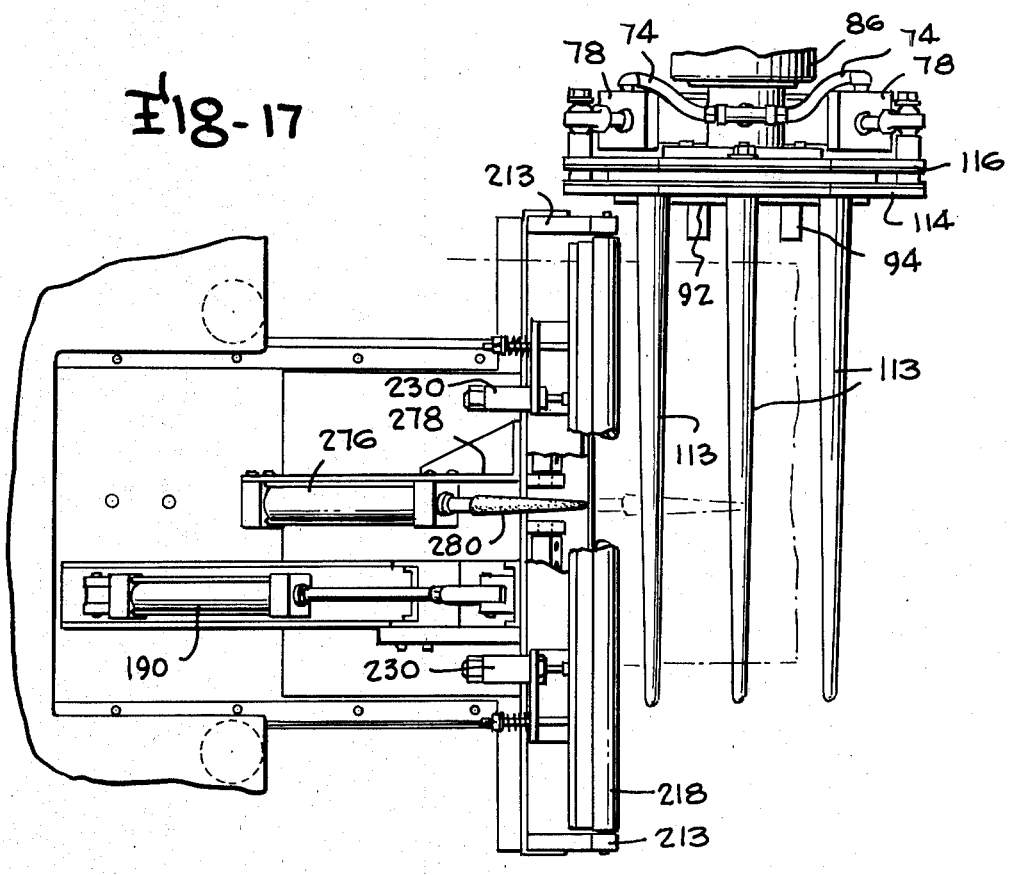
FIG. 17 is a plan view of a portion of the embodiment of FIG. 15.

An alternative embodiment of the invention is illustrated in FIGS. 15 through 17 which differs from the previously discussed embodiments in three respects.

Firstly, the alternative embodiment employs a space-saving arrangement of plural pusher cylinders 270 having their rods connected to a cross head 272 which is connected to the end of the push rod 90. The cylinders 270 are fixed to the main frame components and the operation of the two cylinders gives a more forceful discharging of the completed package from the wrapping station and is of particular advantage when the package components are heavy.

Secondly, the alternative embodiment adds a film push rod cylinder 276 mounted on a bracket 278 attached to the swing gate housing 200. The rod of the film push rod cylinder 276 is provided with a rubber tip 280 which extends through an opening in the swing gate housing 200 and is capable of movement between the solid line position and the dashed line position illustrated in FIG. 16. The purpose of rubber tip 280 is to forcefully engage the web end W' and push it upwardly above the middle tine 113 prior to the loading of the package components in the loading station. Cylinder 276 is extended simultaneously with the operation of the air jet means from the manifold so that an air blast and mechanical operation serves to move the web end W' to the position illustrated in FIG. 17. The rubber tip 280 is immediately retracted following such movement and the air jet serves to maintain the web end in the illustrated position.

Thirdly, the embodiment of FIGS. 15 through 17 employs an air brake 284 that is directly operated by an air line 286 to squeeze the disc 154 to prevent overrun of roll 150 and maintain drag tension during wrapping. The remaining elements of the embodiment illustrated in FIGS. 15 through 17 are identical to the elements of the first embodiment and have consequently been provided with the same reference numerals.

Figure 19:
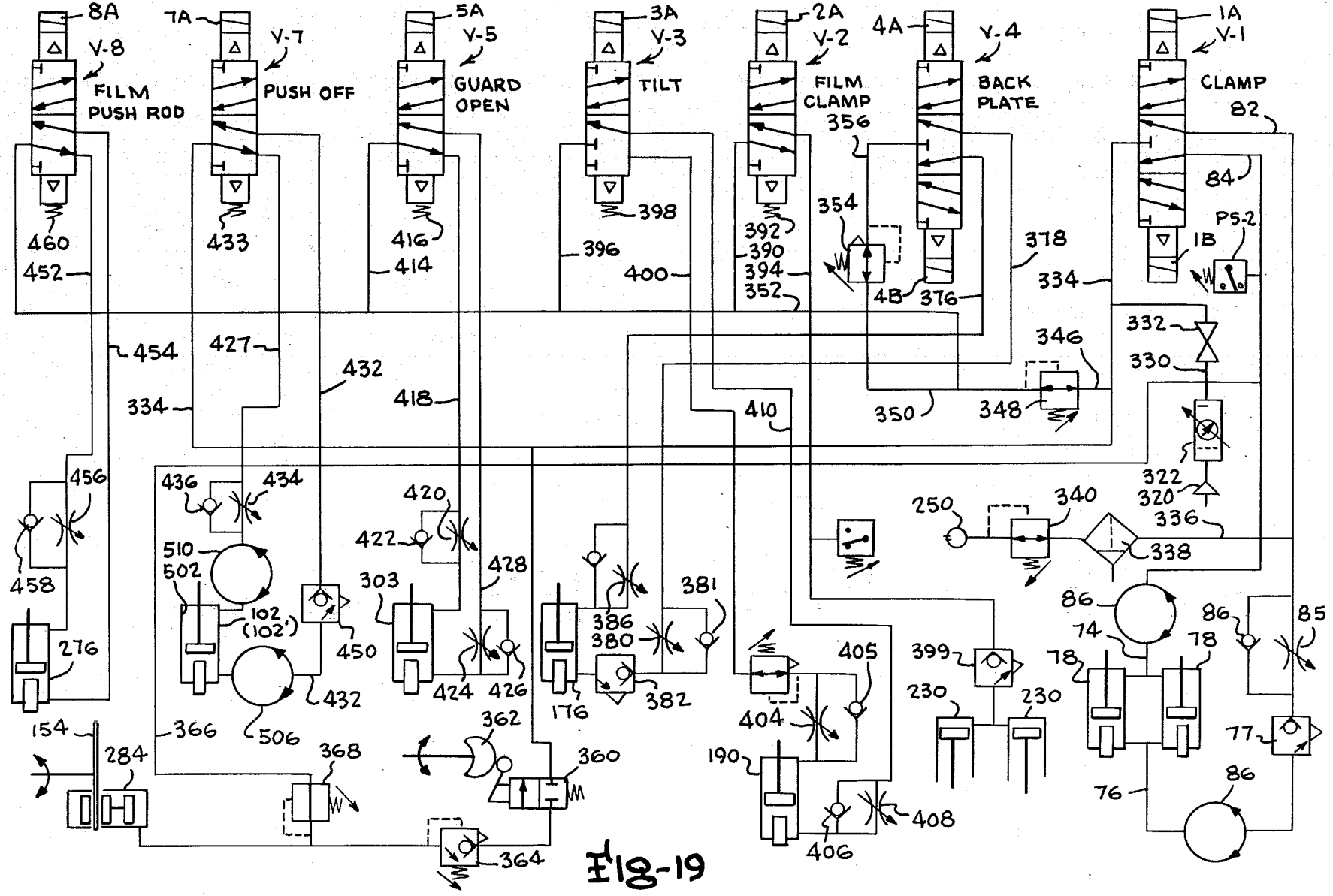
FIG. 19 is an electro-pneumatic schematic of the controlling and operating means for the preferred embodiment.
Figure 22:
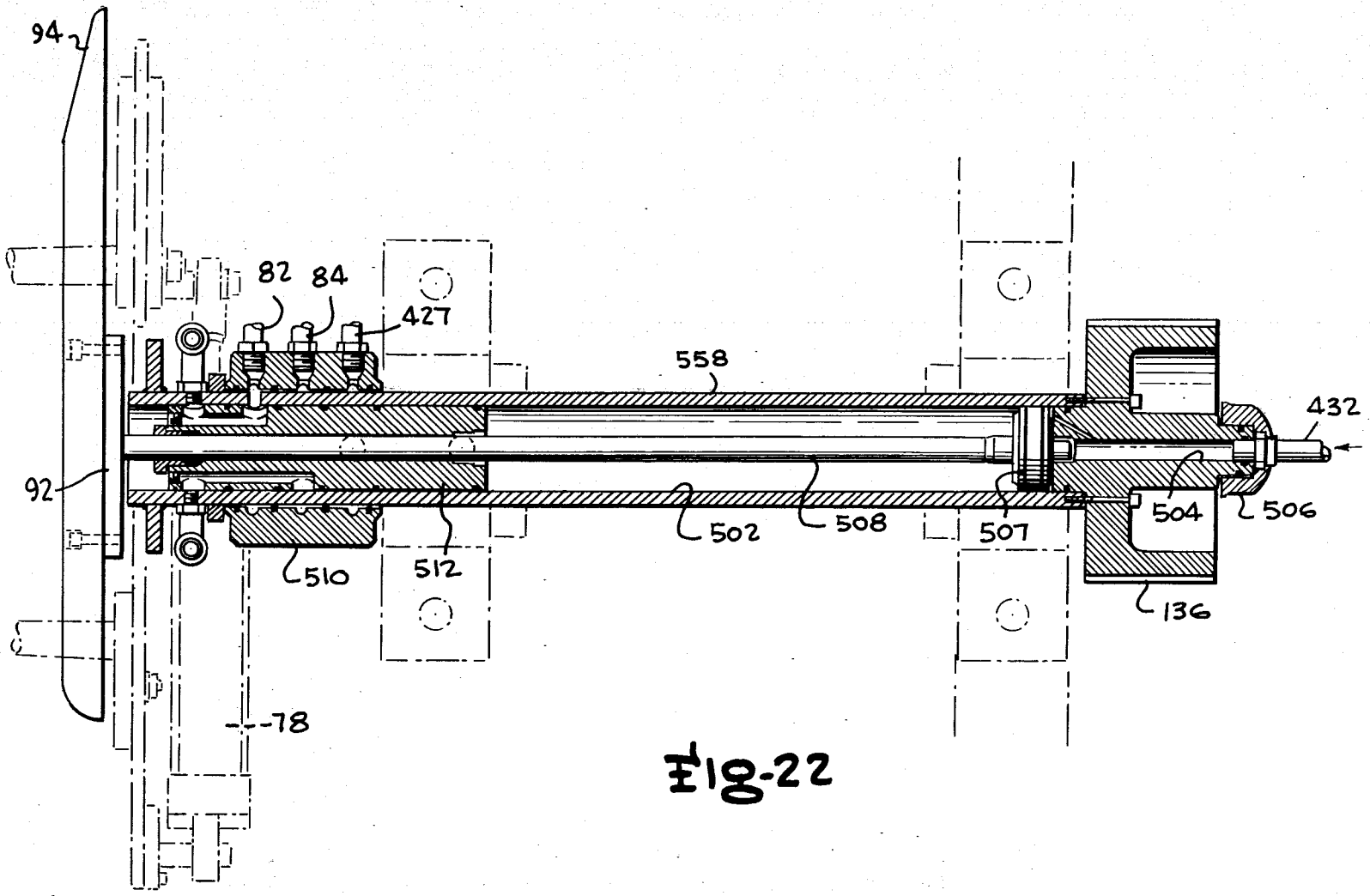
FIG. 22 is a bisecting sectional view of an alternative main shaft construction.

FIG. 22 illustrates an alternative main shaft 558 in which substantial space is saved as compared to the previously discussed embodiments in that the push-off cylinder is formed as an axial bore in the main shaft. More specifically, the shaft 558 includes an axial cylindrical bore 502 with the power input sheave being fixed to one end of shaft 500 and having an axial bore 504 providing communication from a rotary coupling 506 connected to a pressure hose 432 extending from a push-off solenoid control valve V-7 as shown in FIG. 19. Piston 507 has a rod 508, the end of which is connected to pusher 92 in the manner of the previous embodiments. Power air for the clamp cylinders 78 is provided through a rotary coupling 510 having three input openings respectively connected to air supply hose or conduits 82, 84 and 427. Hose 82 communicates with hose 76 to effect contraction of product clamping cylinders 78 which compressed air is provided in hose 82 while compressed air from hose 84 flows to hose 74 to effect expansion of cylinders 78. Conduit 427 communicates with a passageway 512 in rod gland fitting 514 through which rod 508 extends so that pressurized air from conduit 427 flows into the space between the rod side of piston 507 and gland 512 in bore 502 to cause the piston to move to the right to return plate 92 to its home position as illustrated in FIG. 22.

Figure 20:
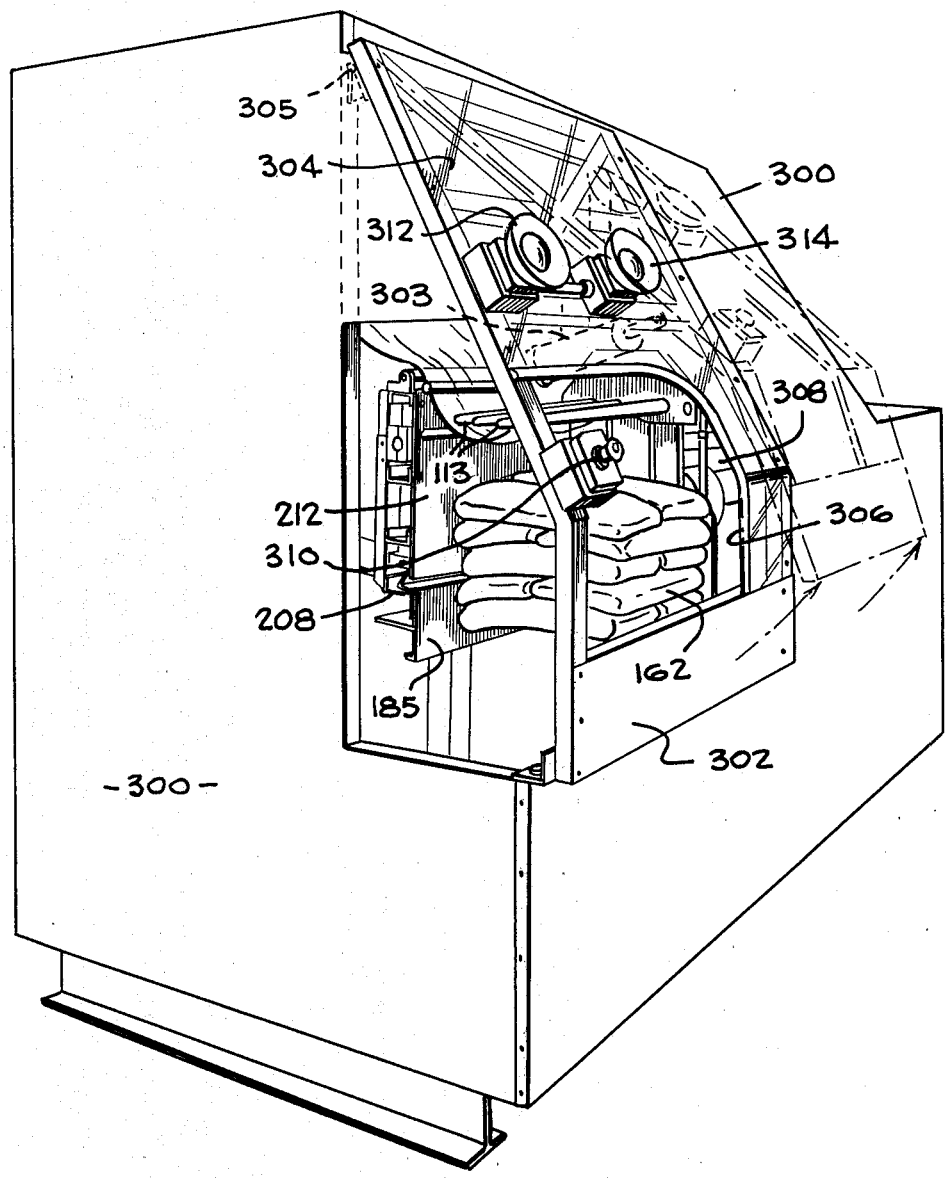
FIG. 20 is a perspective view of the housing for all embodiments including an operator protecting shield illustrated in open and closed positions.

FIG. 20 illustrates a housing 300 in which the previously discussed operating components are enclosed for the protection of the operator. Housing 300 includes a swinging guard shield or panel 302 supported on hinge means 305 for pivotal movement about a pivot axis adjacent its upper edge and powered by a power cylinder 303 for movement between the illustrated closed position and an open dotted line position. Loading of the bags 162 on the tines 113 is accomplished with the guard panel 302 being positioned in its closed position illustrated in FIG. 20. Guard panel 302 includes a transparent plastic panel 304 having an internal edge 306 defining a relatively small access opening 308 which permits the operator to load the bags 162 on tines 111 after the guard panel 302 is in its closed position. Additionally, a main power switch 310 is mounted on the guard panel 302 as are first and second series connected palm switches 312 and 314 which are spaced apart on the guard panel so that the operator must employ both hands in order to effect simultaneous closure of the switch members 312 and 314 with such closure effecting the initiation of movement of the panel 302 to its open position followed by a wrapping operation as is discussed hereinafter. Consequently, it is essential that both hands of the operator be externally located of the guard panel 302 upon initiation of the wrapping operation.

FIG. 19 illustrates the electro-pneumatic control and power system for controlling the various pneumatic cylinders employed in the previously discussed embodiments. Specifically, a source of compressed air 320 at between 90 and 160 pounds per square inch supplies air to a flow control filter regulator 322 which filters the air and maintains a desired pressure range and flow capacity with the air then flowing through a line 330 including a manual adjustment valve 332 to a distribution line 334 which is connected to a plurality of solenoid controlled valve members to be discussed.

The air distribution line 334 is connected to a product clamp valve V1 to which the hose members 82 and 84 are connected with the opposite ends of the hose members being connected to the rotary coupling 86 of the first and second embodiments or to the coupling 510 of the embodiments of FIG. 22 to provide communication with the hoses 76 and 74 connected to the product clamping cylinders 78. Air through hose 76 contracts the cylinders 78 while air in hose 74 extends the cylinders to an unclamping position in which the upper tines 113 are in their position at the greatest possible distance from the lower tines 111 for permitting the loading of the bags 162 on the lower tines. A pressure sensitive switch PS2 is connected to those 84 and has contacts which close when pressure in the hose equals or exceeds a desired value necessary for clamping and safely holding bags 162 during a wrapping operation. The hose 84 extends from the product clamp valve V1 to the rotary coupling 86 to provide communication with the hose 74 which is connected to the rod end of cylinder members 78 so that the supply of compressed air through hose 74 effects a clamping of the package components supported on the lower tines 111. It should be observed that a pressure sensitive switch PS2 is connected to the hose 84 for ensuring that adequate clamping pressure is always present in the hose with switch PS2 serving to prevent operation of the machine by precluding operation of a cycle initiating relay R1 (FIG. 18) in the event of the pressure in hose 84 falling below the predetermined number of pounds per square inch required for maintaining adequate clamping force on the bags 162.

The solenoid controlled product clamp valve V-1 includes a first solenoid 1A which, when actuated, causes the valve member to direct pressurized air from the distribution line 334 to the hose 84 to effect a clamping operation of the product clamping cylinders 78 with hose 82 being vented to atmosphere. A second solenoid 1B when activated effects a supply of pressurized air to the hose 82, which is connected through parallel valves 85 and 86 to the head ends of cylinders 78 to cause the cylinders to extend to their unclamping position with line 84 being vented to atmosphere. Additionally, it should be noted that a quick exhaust valve 77 permits a direct exhausting of the air from the head ends of cylinders 78 during a clamping operation to speed up the completion of the clamping function.

An air curtain supply line 336 extends from the hose line 82 to supply pressurized air through a filter 338 and a step-down regulator 340 to the hose 252 connected to the manifold 250 with the step-down pressure regulator 340 providing air at a reduced pressure of approximately 10 pounds per square inch.

A distribution line 346 is connected to the distribution line 334 and supplies air to a pressure regulator 348 which reduces the air pressure in a line 350 extending therefrom to 50 pounds per square inch. A distribution line 352 is connected to the distribution line 350 to distribute the air at 50 pounds per square inch to a film clamp double solenoid control valve V-2, a back plate tilt solenoid control valve V-3, a guard panel solenoid control valve V-5 and a film push-rod solenoid control valve V-8 as best shown in FIG. 19. The distribution line 350 is also connected to an adjustable pressure regulator valve 354 which supplies air to a line 356 at a reduced pressure of 30 pounds per square inch with line 356 being connected to a back plate ram controlling solenoid control valve V-4.

Also, the distribution line 334 supplies high pressure air at 90 pounds per square inch to a push-off solenoid control valve V-7 and to a cam actuated timed valve 360 which is opened and closed by a cam 362 which is driven by adjustable drive means correlated with and from the main shaft 58. For example, the drive to the cam 362 can be driven so that it rotates one complete revolution for every three revolutions of the main shaft 58 (or 558) with such an arrangement being used when it is desired to wrap the bags with three complete wrappings of the wrapping material. If additional wrappings for each wrapping operation are desired, the drive means could be changed to rotate the cam means 62 at a slower rate compared to the rate of rotation of the main shafts 58 or 558. In any event, cam 362 opens the valve 360 at the end of a wrapping operation to provide compressed air through an adjustable pressure relief check valve 364 through which the high pressure air at approximately 80 pounds per square inch flows to the disc brake unit 284.

Normally, the disc brake is applied approximately 40° before the main shaft reaches the end of the movement; after the shaft comes to a halt, the valve 360 is closed to terminate full braking application. Additionally, a conduit 366 is connected to the conduit 84 to supply air to a pressure reduction valve 368 connected to the hose 286. Air from the valve 368, which is at approximately 25 pounds per square inch, causes the disc brake actuator 284 to exert a constant overrun preventing drag force on the brake disc 154 to prevent overrun of the roll 150.

The back plate ram controlling solenoid control valve V-4 has conduits 376 and 378 connected to it and respectively extending to the rod end and the head end of the carriage drive cylinder 176. Conduit 378 includes an adjustable flow control valve 380, a bypass check valve 381 and a quick exhaust valve 382 which exhausts the head end of cylinder 176 to atmosphere so as to permit the cylinder 176 to be rapidly retracted to retract the carriage plate 38 etc. Similarly, the conduit 376 includes an adjustable flow control valve 386 and a bypassing check valve 388.

Figure 7:
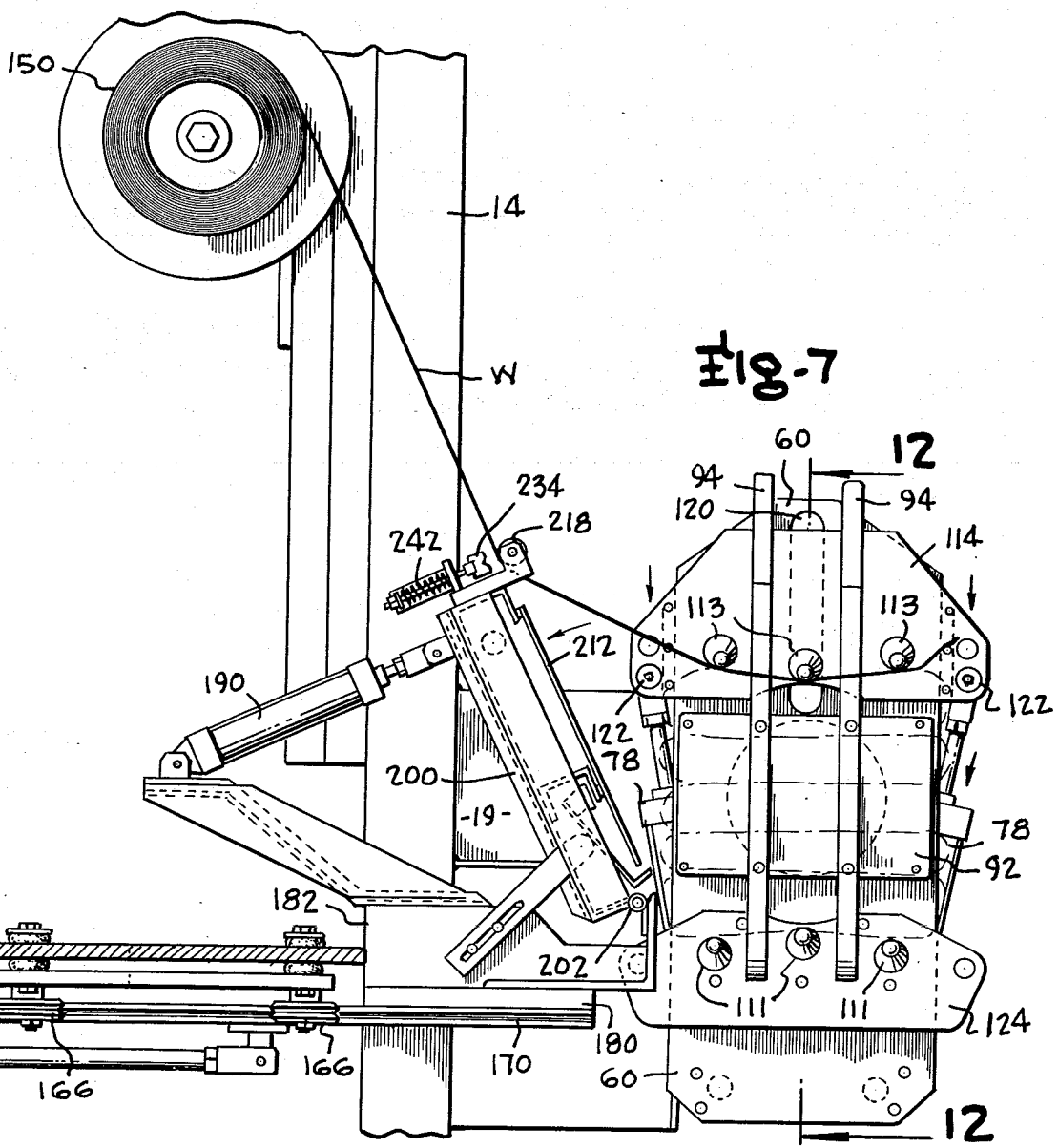
FIG. 7 is a sectional view similar to FIG. 2, but illustrating the parts in a different position during a cycle of operation.

The back plate ram controlling solenoid control valve V-4 has a first solenoid 4A which, when actuated, positions the valve member to provide pressurized air to the conduit 376 to retract the cylinder 176 and the carriage plate 38 etc. and a second solenoid 4B which, when actuated, provides pressurized air to the conduit 378 to extend cylinder 176 and move the main horizontal frame plate 38 and its associated attachments to the forwardly extended position of FIG. 7. Valve V-4 is maintained in the neutral position illustrated in FIG. 19 by centering springs or the like when neither of the solenoids 4A or 4B is actuated.

The film clamp solenoid control valve V-2 is connected by a conduit 390 to the distribution conduit 351 and is normally maintained in the closed position illustrated in FIG. 19 by a positioning spring 392. A conduit 394 extends from valve V-2 and has a pressure responsive switch PS-3 connected to it; conduit 394 is connected to the head ends of the air clamp cylinders 230 through a quick exhaust valve 399 which exhausts the cylinders 230 immediately to atmosphere upon the pressure in conduit 394 falling below a predetermined value. Actuation of a solenoid 2A associated with the valve V-2 positions the valve to provide pressurized air to conduit 394 to cause the air clamp cylinders 230 to be extended to effect a clamping of the web W in an obvious manner.

Figure 9:
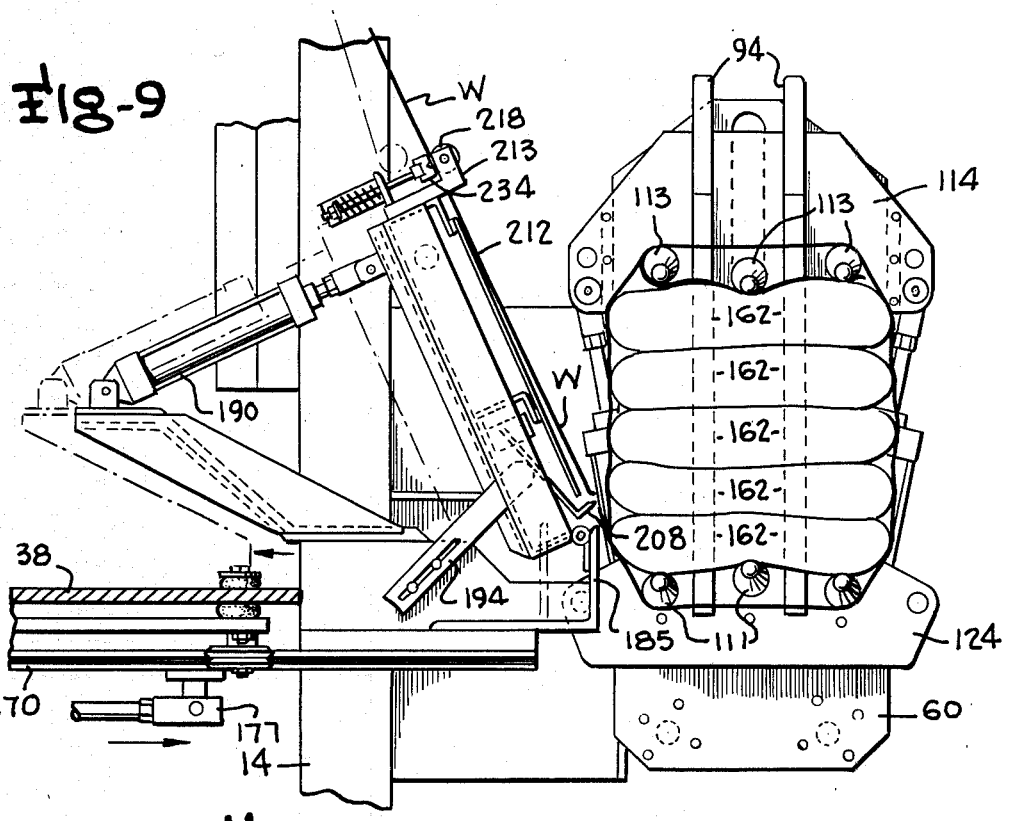
FIG. 9 is a sectional view similar to FIG. 8, but illustrating the parts in a subsequent position during a cycle of operation.
Figure 10:
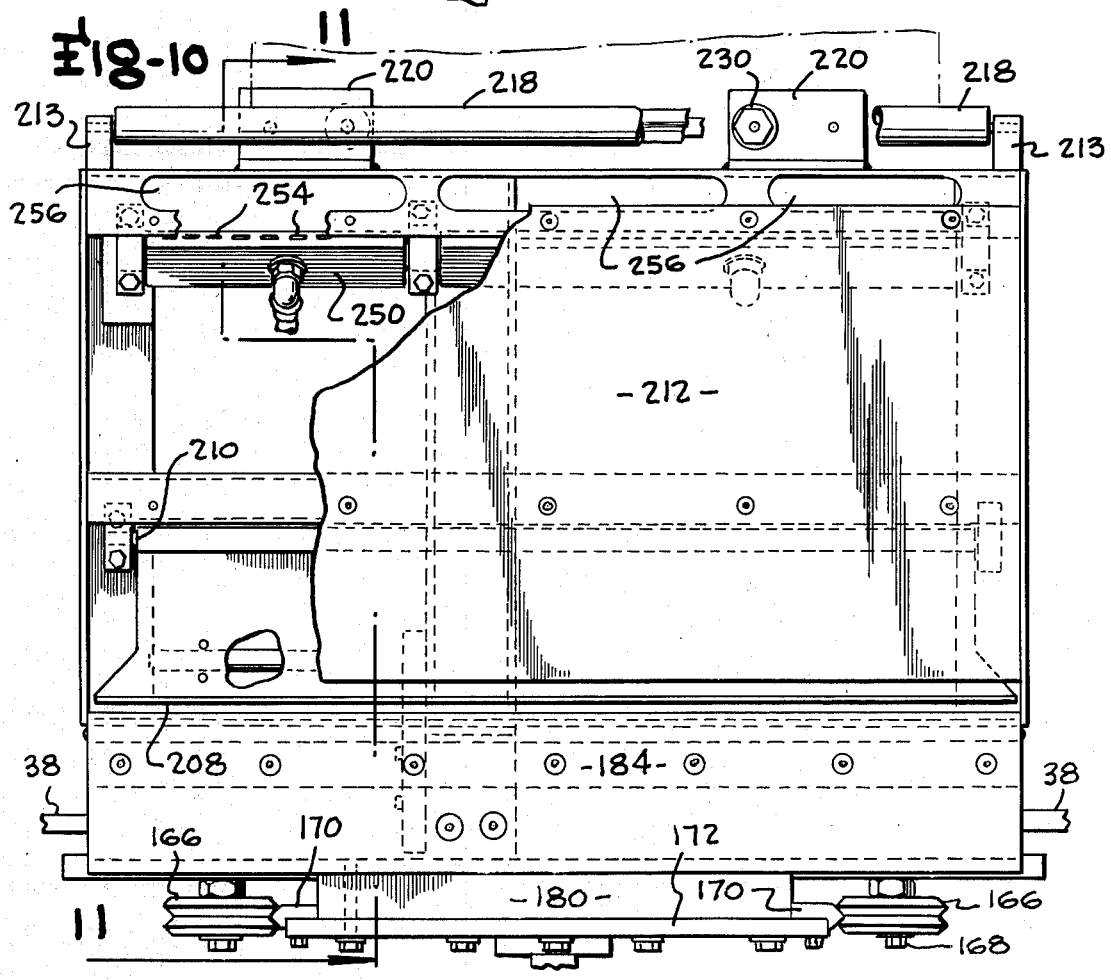
FIG. 10 is a sectional view taken along lines 10—10 of FIG. 2.

The back plate tilt effecting solenoid valve V-3 is connected to the distribution conduit 352 by a conduit 396 and is normally maintained in the position illustrated in FIG. 19 by a biasing spring 398 for supplying pressurized air to a supply conduit 400 to a pressure regulator 402 which reduces the air pressure to approximately 10 pounds per square inch with the air from the regulator flowing through a manually adjustable regulator valve 404 to the rod end of the tilt cylinder to cause the cylinder to contract and tilt the back plate 212 to the position illustrated in FIG. 9. A bypass check valve 405 is also provided in the conduit 400 which also includes a quick exhaust valve. The cylinder end of the tilt cylinder 190 is connected through a bypass check valve 406 and a manually adjustable regulator valve 408 to a conduit 410 exhausting to atmosphere through the valve V-3 when the valve is positioned by spring 398 as shown. Solenoid 3A when actuated serves to position valve V-3 to cause extension of cylinder 190 to effect movement of the back plate 212 to the vertical position illustrated in FIG. 2.

The guard panel solenoid control valve V-5 is connected to the distribution conduit 352 by a conduit 414 with a spring 416 maintaining the valve in the position illustrated in FIG. 19 to provide pressurized air to a conduit 418 connected on its opposite end through a manually adjustable flow control valve 420 and a bypass check valve 422 to the rod end of the guard shield pivoting cylinder 303 with the head end of cylinder 303 being connected through an adjustable valve 424 and a bypassing check valve 426 and conduit 428 to the valve V-5 as shown. When the valve V-5 is positioned in the manner shown illustrated in FIG. 19 by spring 416, the cylinder 303 will be retracted and the pivotal guard shield or panel 302 will be in its closed position; however, actuation of a solenoid V5 causes the valve V-5 to supply pressurized air to the conduit 428 and to vent conduit 418 to atmosphere to extend the cylinder 303 to move the pivot guard shield 302 to its upper dotted line position of FIG. 20.

The push-off solenoid control valve V-7 receives air from the conduit 334 at a pressure in the neighborhood of 90 pounds per square inch and when positioned as shown by srping 433 directs the pressurized air to a conduit 427 having a manually adjustable flow control valve 434 and a parallel by-pass pass check valve 436 with the end of the conduit being connected to the inlet port of the fixed rotary coupling 510 of the embodiment of FIG. 22 communicating with the rod side of the cylinder chamber in which the pushoff piston is located. In the case of the other embodiments, there is obviously no need for such a rotary coupling and the conduit 426 is connected directly to the rod end of the cylinder 102 of FIG. 1. Similarly, in the second embodiment of FIGS. 15 etc., the conduit 426 would not be connected through a rotary coupling and would be simply connected to the head end of the cylinders 270. A second conduit 432 also extends from the push-off solenoid control valve V-7 and is connected through a quick-discharge valve 450 to the single inlet rotary coupling 506 on the end of the main shaft of the third embodiment. Consequently, pressurized air is provided to the head end of the cylinder chamber defined by bore 502 inside the shaft 558 to cause the piston 507 to move to the left to its extended position to push off the completed package from supporting tines 111 following the completion of a wrapping operation. In the case of the first and third embodiments, the conduit 432 would be simply connected to the head end of each of the cylinder 102 and 102' respectively while in the case of the second embodiment of FIG. 15 etc., the conduit 432 would be connected to the rod end of the cylinders 270 for effecting the push-off function. The push-off solenoid control valve V-7 includes a spring 433 normally maintaining the valve in the position illustrated in FIG. 19 in which the push-off plate is retracted since cylinders 102 and 102' are retracted with the cylinders 270 of the second embodiment being extended.

With the push-off solenoid control valve V-7 positioned as in FIG. 19, compression spring 433 acts on the valve member to place the conduit 334 in communication with conduit 426 to provide pressurized air through a parallel flow down valve 434 and a check valve 436 through a rotary coupling 86 to the rod end of the push-off cylinder bore 502 of the embodiment of FIG. 22 and with the head end of the cylinder being exhausted through rotary coupling 506 to a quick exhaust valve 450 so as to retract the piston rod 508 to the retracted position illustrated in FIG. 22. The conduit 426 is directly connected to the rod end of cylinder 102 of the first embodiment illustrated in FIG. 1 etc. without any need for a rotary coupling in the conduit with the head end of cylinder 102 being directly connected to the quick exhaust valve 450. Similarly, the conduit 426 is connected to the head ends of the cylinders 270 of the embodiment of FIG. 15 etc. for retracting the push-off plate without their being any need for the use of rotary couplings. The push-off solenoid control valve V-7 is moved to its second operative position by actuation of a solenoid 7A in which position the conduit 334 is connected to conduit 432 to effect extension of the push-off cylinders 270 to their fully extended condition with such movement effecting the kicking of the of the completed package from the loading station.

The film push rod control solenoid valve V-8 is connected to the conduit 352 and has conduits 452 and 454 respectively extending to the rod and head ends of the cylinder 276 with the conduit 452 including a flow adjustment valve 456 and a parallel check valve 458. A compression spring 460 normally maintains the valve member in the position illustrated in FIG. 19 so as to provide pressurized air to the rod end of cylinder 276 to effect the retraction of the cylinder rod to the solid line position of FIG. 16 while a solenoid 8A is operable to position the valve member in a reverse manner in which the pressurized air is supplied to conduit 454 and conduit 452 is vented to atmosphere so as to extend the cylinder 276 to its dotted line position of FIG. 16.

Figure 18:
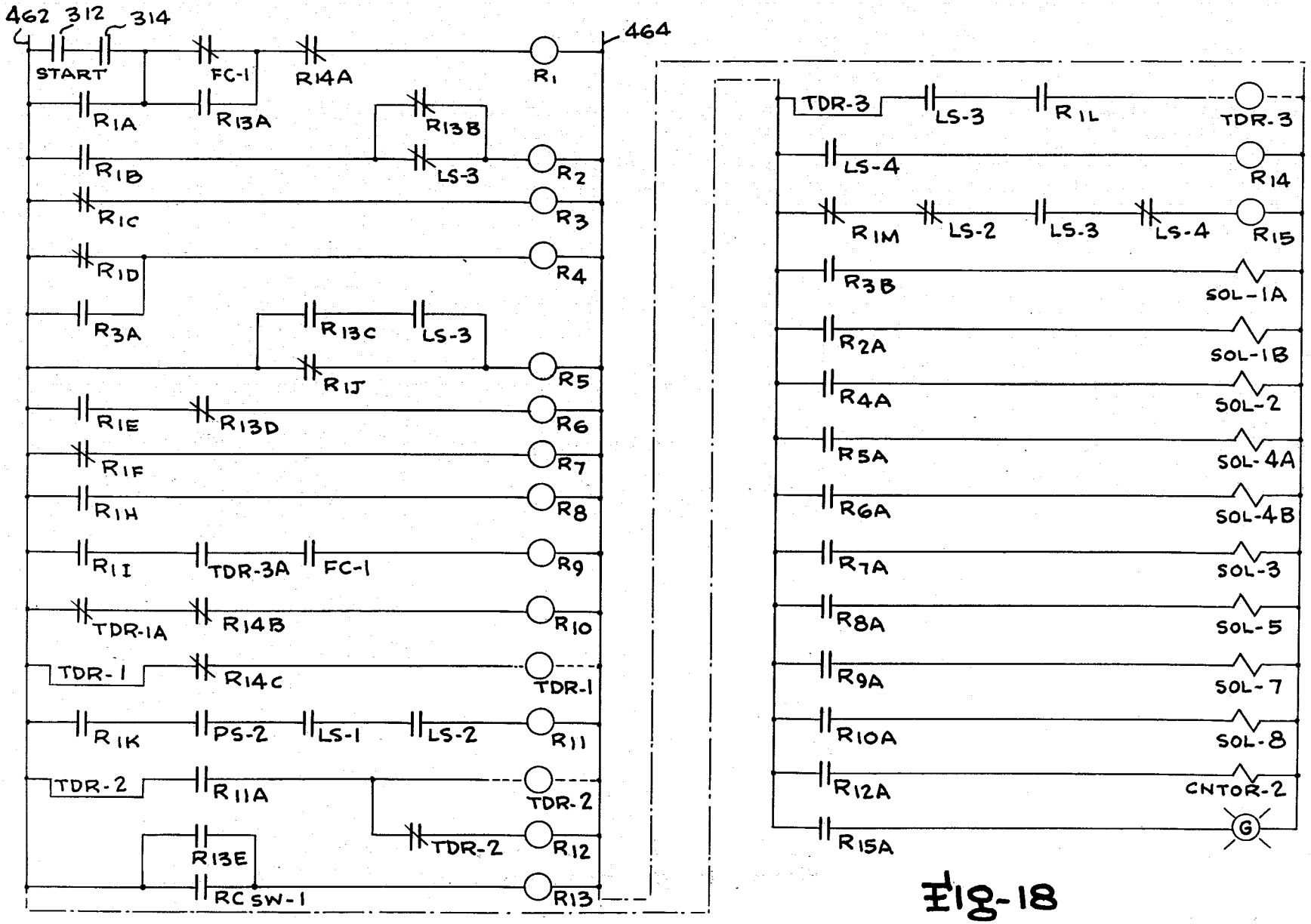
FIG. 18 is a modified ladder diagram illustrating control effecting means for the preferred embodiments.

A cycle of operation will now be described with primary attention being invited to FIG. 19 and the ladder diagram of FIG. 18. Assume that the main power switch 310 is activated to provide power voltage to the drive motor system for rotating the main shaft and to activate the source 320 of compressed air and to provide control voltage to supply conductors 462 and 464 symbolically illustrated in the ladder diagram and that the pressure in the main supply conduit has reached the necessary predetermined level for closing pressure switch PS-2 and the heated cutoff knife 208 receives current to heat it to its operating temperature.

Prior to the beginning of the wrapping cycle, the bags 162 have been stacked on the lower bank of clamp tines 110 and the cylinders 78 are in their extended positions so that the upper bank of tines 112 is spaced at the maximum possible distance from above the lower bank of tines 110. The film clamp 234 is operating to clamp the film as shown in FIG. 11 and pressurized air is provided to the manifold 250 by virtue of the fact that the solenoid 1A of the product clamp valve V-1 is actuated to provide pressurized air to the hose or conduit 82 to effect the extension of cylinders 78 and the supply of air to the manifold. Air from the manifold blows against the lower end W′ of the web to position it beneath the upper band of tines 113 as shown in FIG. 2. The tilt cylinder 190 is in its fully extended position of FIG. 11 and the back plate is in its forward position by virtue of the fact that cylinder 176 is fully extended. The guard 302 is in its closed position. The drive motor 130 is stationary and the film roll brake is only lightly actuated to provide an overrun preventing drag on the film roll. The pusher plate 92 is retracted. Thusly, the machine is ready for the initiation of the wrapping of the stacked bags 162 which is initiated by the operator by simultaneously depressing the palm switches 312 and 314 best illustrated in FIG. 20.

The cycle begins with the closing of the contacts 312 and 314 of the palm switches to actuate relay R1 through the closed contacts of a filmbreak detector switch FC-1 positioned to detect any break in web W and contacts R14A of relay R14. It should be understood that FIG. 18 comprises a logic diagram which functionally illustrates the control means in the form of conventional switches, relays and associated contacts with the contacts of each specific relay being given the same designators as the relay followed by a different letter designator for each contact; however, while such relays could obviously be used, the relay and control function would preferably be effected by solid state relay and logic control means such as the LDC 40 "line-o-logic" modular control system sold by Automatic Timing & Controls Co. of King of Prussia, Pa. The control means also includes a limit switch LS-1 which is closed by the positioning of the back plate carriage in its retracted position by contraction of cylinder 176 and a limit switch LS-2 which is closed by the positioning of the guard panel 302 in its closed position. A limit switch LS-3 which is positioned to be closed in response to the positioning of the back plate carriage in its forward position by extension of cklinder 176. Also, a limit switch LS-4 is normally closed by opens in response to the push-off means 94 etc. being in its fully extended position illustrated in dotted lnes in FIG. 15. Certain of the limit switches effect control operations when in either open or closed condition as functionally and logically illustrated in FIG. 18. Rotary cam switch means RCSW-1, which is preferably an adjustable Model A cam switch such a sold by Candy Mfg. Co. of Evanston, Ill., is driven by the main shaft in timed relation thereto to effect speed control of the motor at an appropriate time in each cycle of operation.

The actuation of relay R1 at the beginning of the cycle immediately results in actuation of solenoid 1B and deactivation of solenoid 1A to cause valve V-1 to direct air to the rod ends of cylinders 78 to initiate clamping of the bags 162. Since hose or conduit 82 is vented to atmosphere during the actuation of cylinders 78 for effecting the clamping of the bags, the flow of air from manifold 250 which is connected to conduit 82 is terminated by the start of the clamping operation. Additionally, the film clamp bar 234 moves to its retracted position illustrated in FIG. 7 and the guard panel 302 begins movement toward its open position. Cylinder 190 contracts to tilt the swing gate housing 200 to its tilted position on carriage plate 38 as shown in FIG. 8 and similarly illustrated in FIG. 9. Eccentric unbalanced support of the swing gate housing by pivot 202 effects the contraction of the cylinder 190 and tends to move the swing gate to its tilted position of FIG. 7 while compressed air is employed for extending the cylinder to the position illustrated in FIG. 16. Also, the carriage drive cylinder 176 immediately begins to contract and move towards its fully contracted position in which the carriage plate 38 is completely retracted as illustrated in FIG. 8.

Arrival of the carriage drive cylinder 176 at its fully retracted position illustrated in FIG. 8 occurs at approximately the same time that the guard panel 302 reaches its open position to close the contacts of limit switch LS-2. Motor 130 is actuated by starter CNTOR-2 at low speed and the brake means in the clutch-brake unit 142 is simultaneously deactivated and the clutch is activated to initiate rotation of the main shaft which subsequently actuates rotary cyclic switches such as RCSW-1 in succession to provide motive current to additional motor coils to progressively but quickly bring the motor to full speed operation.

Figure 21:
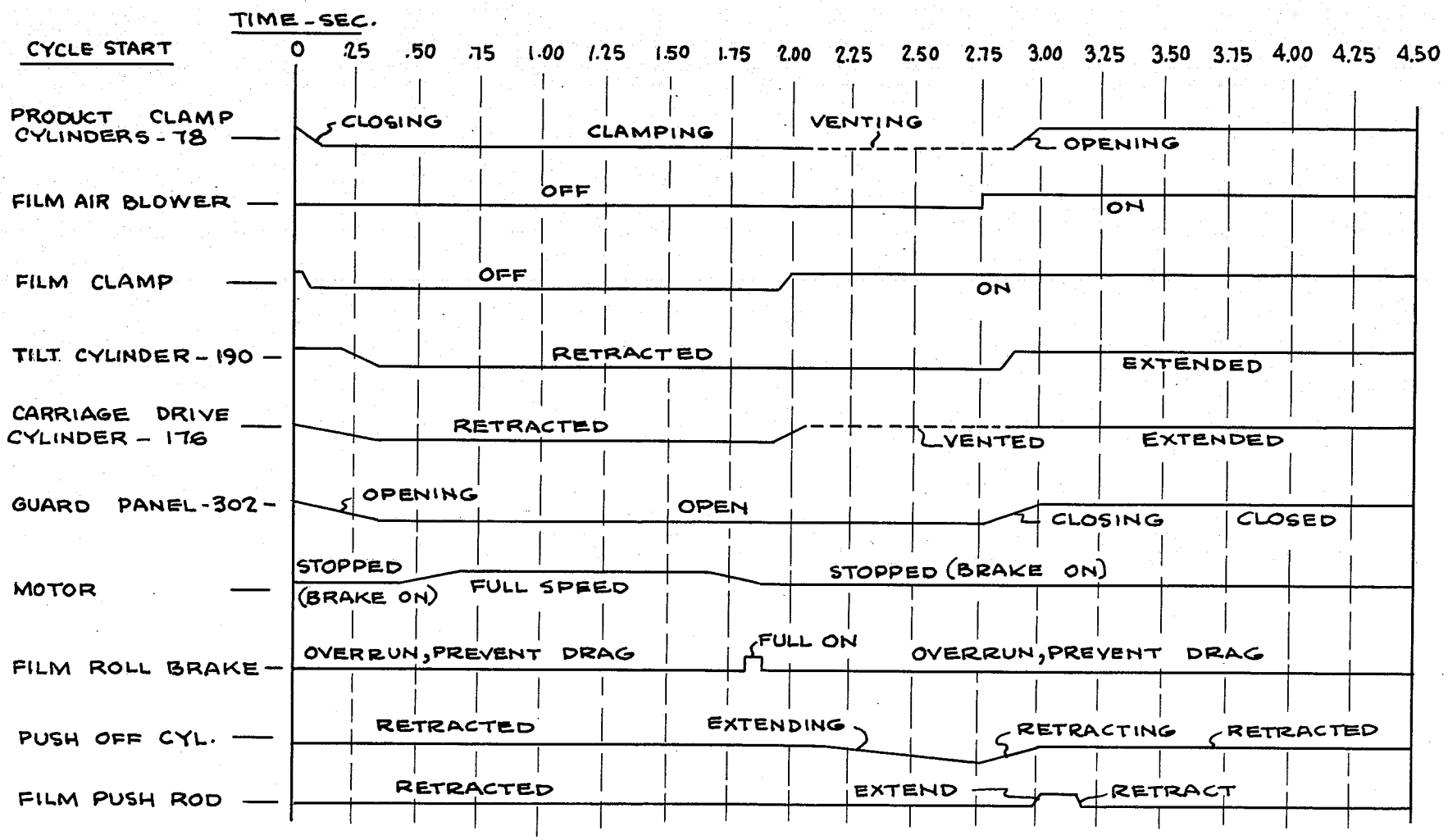
FIG. 21 is a timing chart illustrating a complete cycle of operation.

After the main shafts 50A (or 550A) have rotated for a desired number of revolutions for effecting a desired number of wrappings of the web W about the bags 162, counter switch means driven by the main shaft initiates deactivation of all of the windings of the motor, disengagement of the clutch and application of the brake to bring the wrapped package to a full halt in the position illustrated in FIG. 9. Valve 360 is opened by a cam 362 symbolically illustrated in FIG. 19 to supply high pressure air to the film roll brake means 284 to effect full braking action for a short time period as shown in FIG. 21 to prevent overrun of roll 150 as the rotation of the completed package is being terminated.

The film clamp means 234, 236 is actuated to clamp the web W and the cylinder 176 is extended to move the carriage plate 38 to the right from the position of FIG. 8. Since the swing gate housing 200 remains in its tilted position, the hot knife edge 208 is extended outwardly of the positioning plate 212 and the hot knife edge engages the web W as shown in FIG. 9 to sever the web from the package. The pressure plate 185 engages the severed end of the web and presses it against the package to bind it to the underlying film layer. The solenoid 4A is then deenergized to vent the head end of cylinder 176 so that the pressure of the plate 184 against the side of the completed package is relaxed. Simultaneously, the solenoid 1B is deenergized so that clamping pressure on the package components 162 is relaxed; however, it should be understood that the cylinders 78 are not activated to extend them to their fully extended position at this time.

The solenoid 7A of valve V-7 is then actuated to effect extension of the push-off means 502 of the embodiment of FIG. 22 or contraction of cylinders 270 of the embodiment of FIG. 15 or extension of cylinder 102 of the embodiment of FIG. 1 as the case may be and the completed package is consequently kicked from the supporting tines 111. Arrival of the pusher plate 94 at its fully extended dotted line position results in activation of a limit switch LS-4, the closure of which initiates return of the pusher means to its retracted position.

Solenoid 4A is then energized to fully extend cylinder 176 and the tilt cylinder 190 is simultaneously energized by actuation of solenoid 3A of valve V-3 to pivot member 200 to its vertical position. Film push rod 280 is momentarily extended to the dotted line position of FIG. 16 to position the web end W' as shown in said figure with the upper bank of tines 113 being in their elevated spaced condition from the lower bank of tines; since the blower is on at this time, the web is held in position by air from manifold 250.

The guard panel is then closed by virtue of deenergization of solenoid valve V-5 and an indicator lamp G on the panel is actuated to indicate that the machine is ready for the loading of the next group of package components. It will be seen from FIG. 21 that the entire wrapping cycle is completed in less than 4.5 seconds. In some instances, depending upon the number of wraps and nature of the items being wrapped, the cycle can be completed in less time.

We claim:

1. A package wrapping machine comprising frame means, a power driven rotary member mounted on said frame means for movement with respect to said frame limited solely to rotation about a horizontal axis, a loading and wrapping station including clamping means mounted on said rotary member for linear movement thereon and rotation therewith about said horizontal axis while clamping and holding package components to be wrapped, power drive means carried on said rotary member for actuating said clamping means, plastic film feeding and supply means mounted on said frame means for providing a web of plastic film extending to said clamping means and package components held by clamping means so that rotation of said rotary member and said clamping means about said horizontal axis effects the wrapping of said package components by said web of plastic film while said package components are held by said clamping means, film cut-off means for severing the web of plastic film from the wrapped package following the wrapping of the package, control means for actuating said clamping means, said rotary member and said film cut-off means in timed sequence, wherein said plastic film feeding and supply means includes roll support means supporting a roll of plastic film for rotation about a horizontal axis at a fixed location on said frame means, a carriage mounted for reciprocation between inner and outer limit positions toward and away from package components held by said clamping means, film guide means mounted on said carriage, said web of plastic film extending through said film guide means, said film cut-off means comprising an elongated heated means supported on said carriage for engagement with said web upon movement of said carriage toward said package through a position near said inner limit position, carriage support means supporting said carriage for reciprocation between said inner and outer limit positions, a vertically extending swing gate extending upwardly from said carriage, pivotal support means on said carriage supporting said swing gate along a lower portion thereof for pivotal movement about a horizontal axis, a back plate on said swing gate facing said package components, said swing gate being pivotable between an erect position in which said back plate is vertically oriented and a canted position in which the upper portion of said back plate is tilted away from said package components toward the outer limit position of said carriage, said back plate being oriented in its vertical position when said carriage is in its inner limit position and serving as a positioning means against which the components of a package to be wrapped are positioned preparatory to the clamping thereof by said clamping means and power tilt means mounted on said carriage for moving said back plate between its vertical position and its canted position and carriage drive means for moving said carriage between its inner limit position and its outer limit position.

2. The invention of claim 1 wherein said film guide means comprises a horizontal idler guide roller mounted along an upper edge of said swing gate with said web of plastic film extending over a portion of said horizontal idler guide roller.

3. The invention of claim 2 wherein said elongated heated means comprises an electrically heated blade having a hot edge portion extending along the lower edge of said back plate, means on said swing gate supporting said blade edge for movement between an extended position in which said hot edge portion extends beyond the back plate toward the loading station and a retracted position in which the hot edge portion is positioned behind the back plate and means for moving the edge portion to its extended position in response to movement of said swing gate to its canted position.

4. The invention of claim 3 additionally including selectively actuated film clamping means positioned adjacent said horizontal idler guide roller for clamping said web of plastic film against said horizontal idler guide roller.

5. The invention of claim 4 additionally including package ejecting means for ejecting a wrapped package from said clamping means at the completion of a cycle of operation.

6. The invention of claim 5 wherein said clamping means includes first and second spaced banks of tine members having horizontal axes and said power drive means includes fluid power cylinder means for effecting relative movement of said first and second banks of tine members toward each other to effect the clamping of package components positioned between said first and second banks of tine members and for effecting movement of said tine banks to a position of maximum spacing to permit the positioning of package components between said banks of tine members preparatory to the wrapping of said package components.

7. The invention of claim 6 wherein said rotary member includes a horizontal main shaft having a forward end portion and a rearward end portion, means supporting said main shaft on said frame means for rotation about said horizontal axis and a vertically oriented turret plate attached to said forward end portion of said main shaft.

8. The invention of claim 7 wherein each of said first and second banks of tine members includes a tine support plate, means supporting one of said tine support plates for reciprocation on said turret plate toward and away from the other tine support plate.

9. The invention of claim 8 additionally including connector means mounting said fluid power cylinder means on said turret plate said fluid power cylinder means being also connected to one of said tine support plates for moving said one tine support plate toward the other tine support plate for effecting relative movement of said first and second banks of tine members toward each other to cause the clamping of package components positioned between said first and second banks of tine members and for effecting the relative movement of said banks of tine members in a direction away from each other.

10. The invention of claim 9 additionally including selectively operable overrun preventing brake means for prevening rotation of said roll of plastic film.

11. A package wrapping machine comprising frame means, a power driven rotary member mounted on said frame means for movement with respect to said frame limited solely to rotation about a horizontal axis, a loading and wrapping station including clamping means mounted on said rotary member for linear movement thereon and rotation therewith about said horizontal axis while clamping and holding package components to be wrapped, power drive means carried on said rotary member for actuating said clamping means, plastic film feeding and supply means mounted on said frame means for providing a web of plastic film extending to said clamping means and package components held by clamping means so that rotation of said rotary member and said clamping means about said horizontal axis effects the wrapping of said package components by said web of plastic film while said package components are held by said clamping means, film cut-off means for severing the web of plastic film from the wrapped package following the wrapping of the package, control means for actuating said clamping means, said rotary member and said film cut-off means in timed sequence, wherein said clamping means includes first and second banks of elongated tine members having horizontal axes and said power drive means includes means for effecting relative linear movement of said first and second banks of tine members toward each other to effect the clamping of package components positioned between said first and second banks of tine members and for effecting the relative movement of said banks of tine members away from each other to a fully open position to permit the positioning of package components between said banks of tine members preparatory to the wrapping of said package components, wherein said rotary member includes a horizontal shaft having a forward cantilever end portion supported on said frame means for rotation about said horizontal shaft having a forward cantilever end portion supported on said frame means for rotation about said horizontal axis, a turret plate oriented in a vertical plane attached to said forward cantilever end portion of said horizontal shaft and wherein each of said first and second banks of tine members includes a vertically oriented tine support plate to which the tines of the respective bank are secured on one end, and additionally including vertically extending package ejecting means normally positioned adjacent said turret plate between said first and second banks of tine members and power cylinder means for moving said package ejecting means outwardly horizontally between said first and second banks of tine members to effect removal of a wrapped package from between said banks of tine members, wherein said plastic film feeding and supply means includes roll support means mounted on said frame supporting a roll of plastic film for rotation about a horizontal axis, a carriage mounted for reciprocation between inner and outer limit positions toward and away from said package components held by said clamping means, film guide means mounted on said carriage, said web of plastic film extending through said film guide means, said film cut-off means comprising an elongated heated means supported on said carriage for engagement with said web upon movement of said carriage toward said package through a position near said inner limit position and air blower means on an upper portion of said carriage for moving the severed end of the web upwardly against the lower sides of tines of an upper one of said banks of elongated tine members following the ejection of a wrapped package and pusher means mounted on said carriage engageable with the severed end of the web for pushing same upwardly toward the tines of said upper one of said tine banks in conjunction with said air blower means.

12. The invention of claim 11 additionally including carriage support means supporting said carriage for reciprocation between said inner and outer limit positions, a vertically extending swing gate extending upwardly from said carriage, pivotal support means on said carriage supporting said swing gate along a lower portion thereof for pivotal movement about a horizontal axis, a back plate on said swing gate facing said package components, said swing gate being pivotable between an erect position in which said back plate is vertically oriented and a canted position in which the upper portion of said back plate is tilted away from said package components toward the outer limit position of said carriage, said back plate being oriented in its vertical position when said carriage is in its inner limit position and serving as a positioning means against which the components of a package to be wrapped are positioned preparatory to the clamping thereof by said clamping means and further including power tilt means mounted on said carriage for moving said back plate between its vertical position and its canted position and carriage drive means for moving said carriage between its inner limit position and its outer limit position.

13. The invention of claim 12 wherein said film guide means comprises a horizontal idler guide roller mounted along an upper edge of said swing gate with said web of plastic film extending over a portion of said horizontal idler guide roller and wherein said swing gate is eccentrically supported so that its weight tends to move said swing gate to its canted position.

14. The invention of claim 13 wherein said elongated heated means comprises an electrically heated blade having a hot edge portion extending along the lower edge of said back plate, means on said swing gate supporting said blade edge for movement between an extended position in which said hot edge portion extends beyond the back plate toward the loading station and a retracted position in which the hot edge portion is positioned behind the back plate and means for moving the edge portion to its extended position in response to movement of said swing gate to its canted position.

* * * * *